US007614461B2

(12) United States Patent
Barbera

(10) Patent No.: US 7,614,461 B2
(45) Date of Patent: Nov. 10, 2009

(54) LUBRICATED PILOT TUBES FOR USE WITH AUGER BORING MACHINE PILOT STEERING SYSTEM AND USE THEREOF

(76) Inventor: James S. Barbera, 1635 37th St. NW., Canton, OH (US) 44709

( * ) Notice: Subject to any disclaimer, the term of this patent is extended or adjusted under 35 U.S.C. 154(b) by 90 days.

(21) Appl. No.: 11/714,995

(22) Filed: Mar. 7, 2007

(65) Prior Publication Data

US 2008/0217066 A1 Sep. 11, 2008

(51) Int. Cl.
*E02D 29/00* (2006.01)
*E21B 7/04* (2006.01)

(52) U.S. Cl. ..... 175/62; 175/320; 299/1.3

(58) Field of Classification Search ..... 175/340, 175/61, 62, 320; 138/155, 114–116; 299/1.3, 299/30

See application file for complete search history.

(56) References Cited

U.S. PATENT DOCUMENTS 417,992 A * 12/1889 Dell ..... 138/114
1,481,255 A * 1/1924 Cumfer ..... 165/154
4,280,535 A * 7/1981 Willis ..... 138/112
4,387,775 A * 6/1983 Adolfsson et al. ..... 175/135
4,630,967 A 12/1986 Soltau
5,186,579 A * 2/1993 Hanamoto et al. ..... 405/143
5,400,828 A * 3/1995 Ziu et al. ..... 138/113
5,711,385 A 1/1998 Brotherton
6,206,109 B1 3/2001 Monier et al.
6,311,790 B1 * 11/2001 Beckwith et al. ..... 175/62
7,134,514 B2 * 11/2006 Riel et al. ..... 175/320
2005/0034853 A1 * 2/2005 Robichaux et al. ..... 166/85.1
2005/0103527 A1 * 5/2005 Church et al. ..... 175/62

* cited by examiner

*Primary Examiner*—David J Bagnell
*Assistant Examiner*—Cathleen R Hutchins
(74) *Attorney, Agent, or Firm*—Sand & Sebolt

(57) ABSTRACT

A pilot tube for an auger boring machine has a lubrication through passage formed therein through which water or another lubricant may be pumped during the driving of the pilot tube to facilitate formation of a pilot hole in the earth which is subsequently followed by an auger in forming a trenchless hole for laying underground pipe. Preferably, the lubrication passage extends to exit openings adjacent or on a steering head. A lubrication feed swivel is connected the trailing end of the pilot tube for feeding the water into the pilot tube while allowing rotation of the pilot tube for the steering thereof during the process of driving the pilot tube.

28 Claims, 16 Drawing Sheets

LUBRICATED PILOT TUBES FOR USE WITH AUGER BORING MACHINE PILOT STEERING SYSTEM AND USE THEREOF

BACKGROUND OF THE INVENTION

1. Technical Field

The invention relates generally to an auger boring machine and a method of use in the trenchless installation of underground pipe. More particularly, the invention relates to such a machine which utilizes a pilot tube for forming a pilot hole for guiding the auger of the machine. Specifically, the invention relates to a lubricated pilot tube and drive assembly used in forming the pilot hole.

2. Background Information

The use of an auger boring machine for installing underground pipe between two locations without digging a trench there between is broadly known. In addition, it is known to use a pilot tube formed of a plurality of pilot tube segments to create a pilot hole for guiding an auger which bores a larger hole so that the auger remains within a reasonably precise line and grade. For example, see U.S. Pat. No. 6,206,109 granted to Monier et al. However, it requires an enormous amount of force to drive the pilot tube through the ground due to frictional engagement between the pilot tube and soil, as well as to the pilot tube's inherent compacting and displacement of soil. Thus, there is a need in the art to minimize the difficulties associated with these effects. The present invention solves this and other problems in the art.

BRIEF SUMMARY OF THE INVENTION

The present invention provides an apparatus comprising: an auger boring machine pilot tube having leading and trailing ends and adapted for being driven into the earth to form a pilot hole to be followed by an auger; and at least one lubrication through passage formed in the pilot tube from adjacent the trailing end to adjacent the leading end.

The present invention further provides a method comprising the steps of: driving a pilot tube having leading and trailing ends into the earth to form a pilot hole therein adapted for guiding an auger; and moving water from the trailing end toward the leading end through a lubricant through passage formed in the pilot tube during the step of driving.

BRIEF DESCRIPTION OF THE SEVERAL VIEWS OF THE DRAWINGS

FIG. 9 also illustrates the flow of lubricant through the pilot tube to the steering head.

Similar numbers refer to similar parts throughout the drawings.

DETAILED DESCRIPTION OF THE INVENTION

Figure 1:
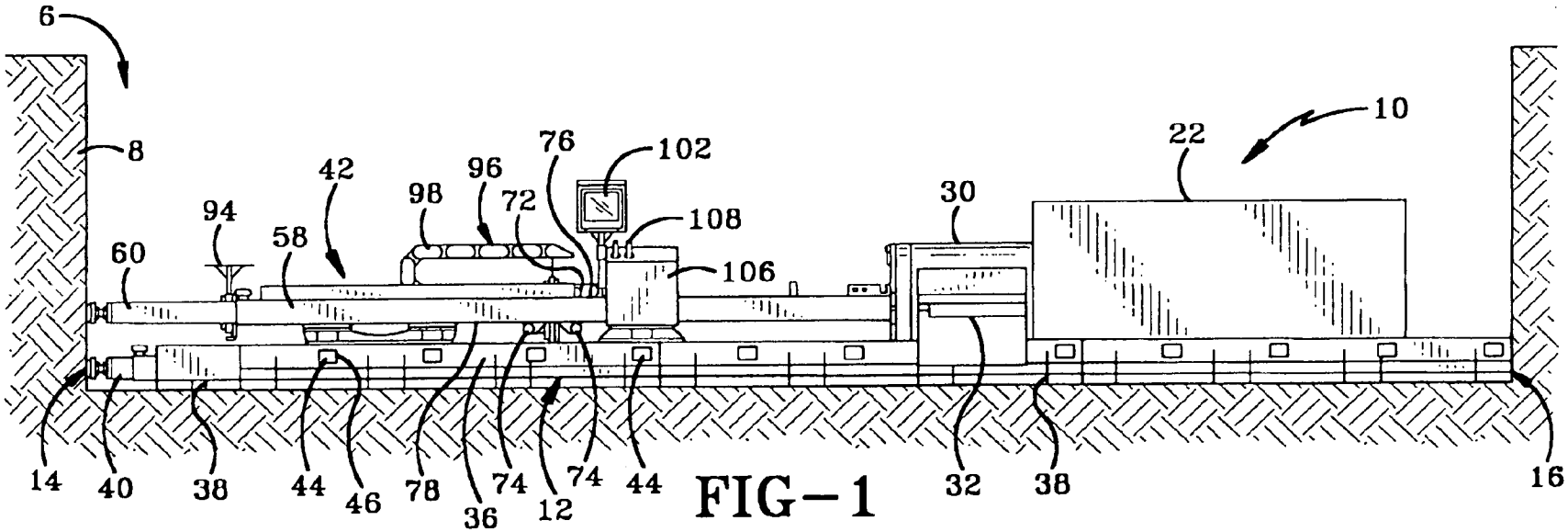
FIG. 1 is a side elevational view of the auger boring machine of the present invention shown in a pit formed in the earth.
Figure 2:
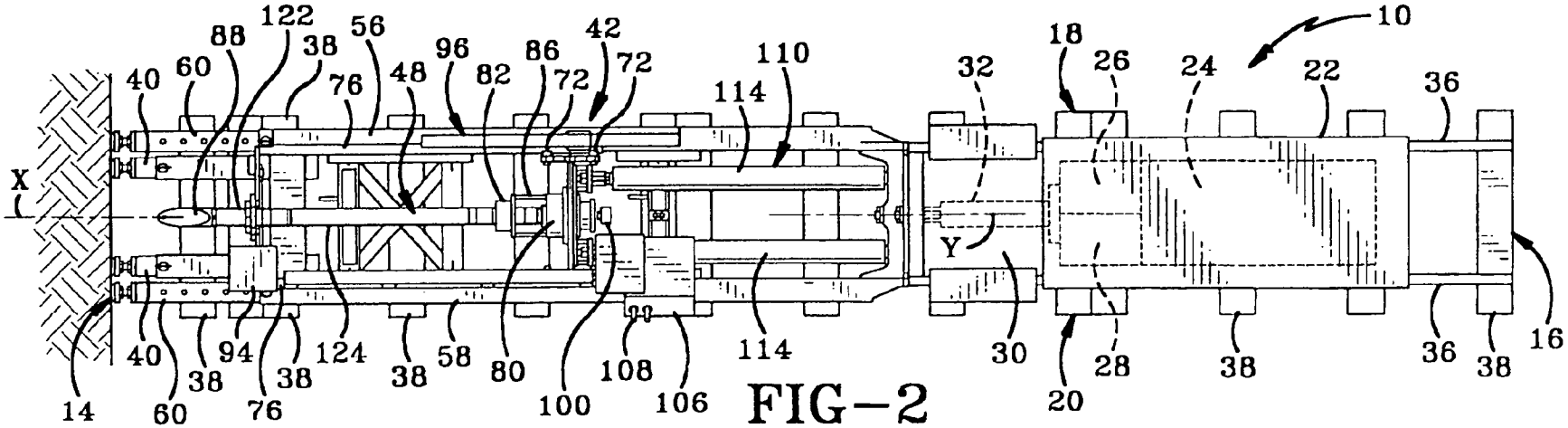
FIG. 2 is a top plan view of the auger boring machine.

The auger boring machine of the present invention is indicated generally at 10 in FIGS. 1 and 2. Referring to FIG. 1, machine 10 is typically disposed in a pit 6 formed in the earth's soil or ground 8 and configured to bore a hole through ground 8 for the purpose of laying underground pipe in the bored hole. Machine 10 typically bores a hole from within a pit such as pit 6 to another pit which may be spaced several hundred feet away. Machine 10 includes a lubrication system for pumping a lubricant such as water through the pilot tube and steering head in order to facilitate formation of the pilot hole. Machine 10 includes a frame 12 which extends from a front end 14 to a rear end 16 of machine 10. Front and rear end 14 and 16 define there between a longitudinal direction of machine 10. Machine 10 further has first and second opposed sides 18 and 20 (FIG. 2) defining there between an axial direction of machine 10.

Figure 18:
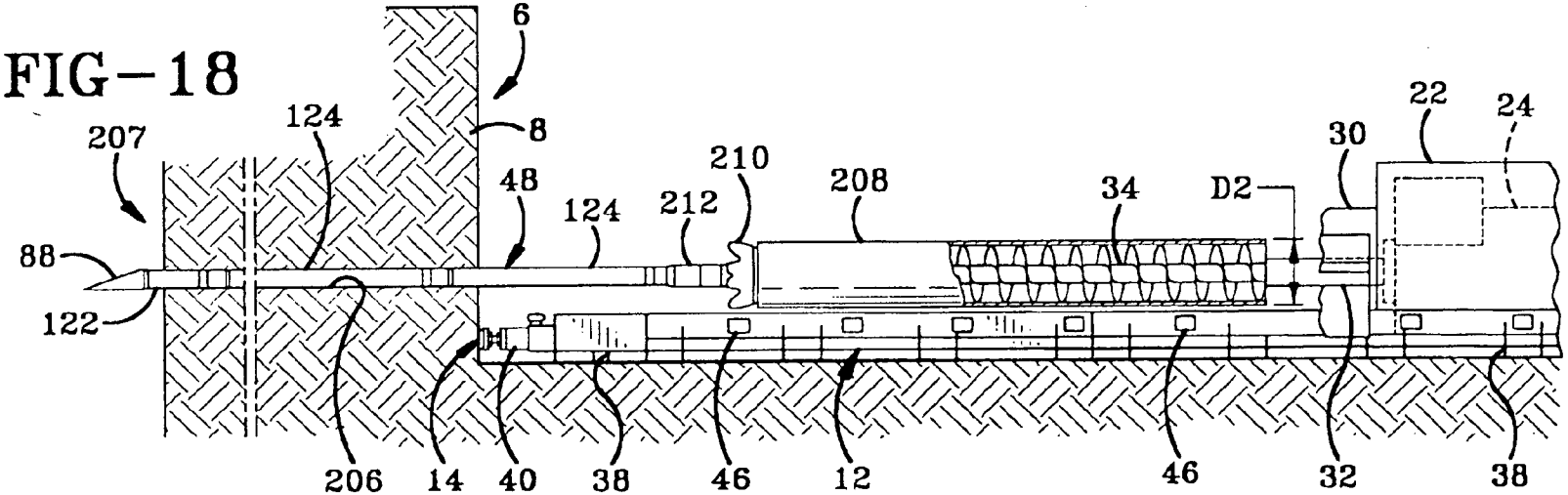
FIG. 18 is similar to FIG. 17 and shows the auger and swivel connected to the auger drive and pilot tube.

An engine compartment 22 is mounted on frame 12 and houses therein a fuel powered engine 24, an electric generator 26 powered by engine 24 and a hydraulic pump 28 also powered by engine 24. An auger drive compartment 30 is disposed in front of compartment 22 and houses therein an auger drive having a rotational output shaft 32 for rotationally driving an auger 34 (FIG. 18). Frame 12 further includes a pair of spaced longitudinally extending rails 36 secured to a plurality of cross bars 38 which are mounted on ground 8 in the bottom of pit 6. A pair of adjustable stabilizing poles 40 are telescopically received in and adjustably mounted respectively on rails 36 and configured to press against the wall of ground 8 which bounds pit 6.

A pilot tube guidance and drive assembly 42 is removably mounted on frame 12 and more particularly on rails 36 via mounting legs 44 which are removably insertable into openings 46 formed in each of rails 36. Mounting legs 44 and the mounting mechanism of which they are a part are described in further detail in the copending application entitled Pilot Tube System And Attachment Mechanism for Auger Boring Machine which is incorporated herein by reference and filed concurrently herewith. Assembly 42 when mounted on frame 12 is positioned so that a central longitudinal axis X of a cylindrical pilot tube 48 is coaxial with a longitudinal axis Y which passes centrally through output shaft 32 and about which shaft 32 is rotated when driving auger 34. Assembly 42 includes a generally circular rear plate 50 which abuts compartment 30 when assembly 42 is mounted on frame 12 and includes a portion which is inserted into compartment 30 to assist with the alignment of assembly 42.

Figure 3:
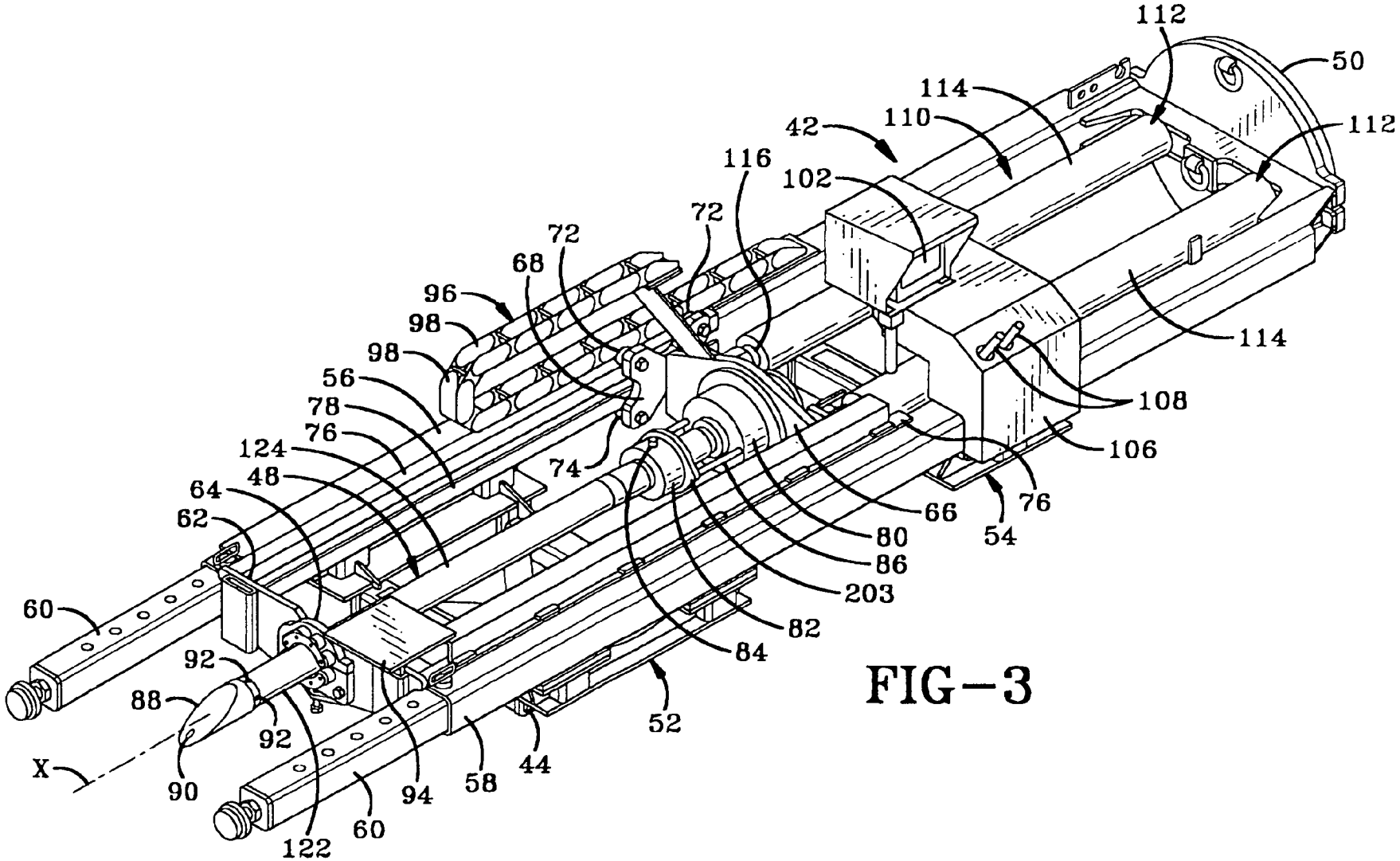
FIG. 3 is a perspective view of the drive assembly.
Figure 4:
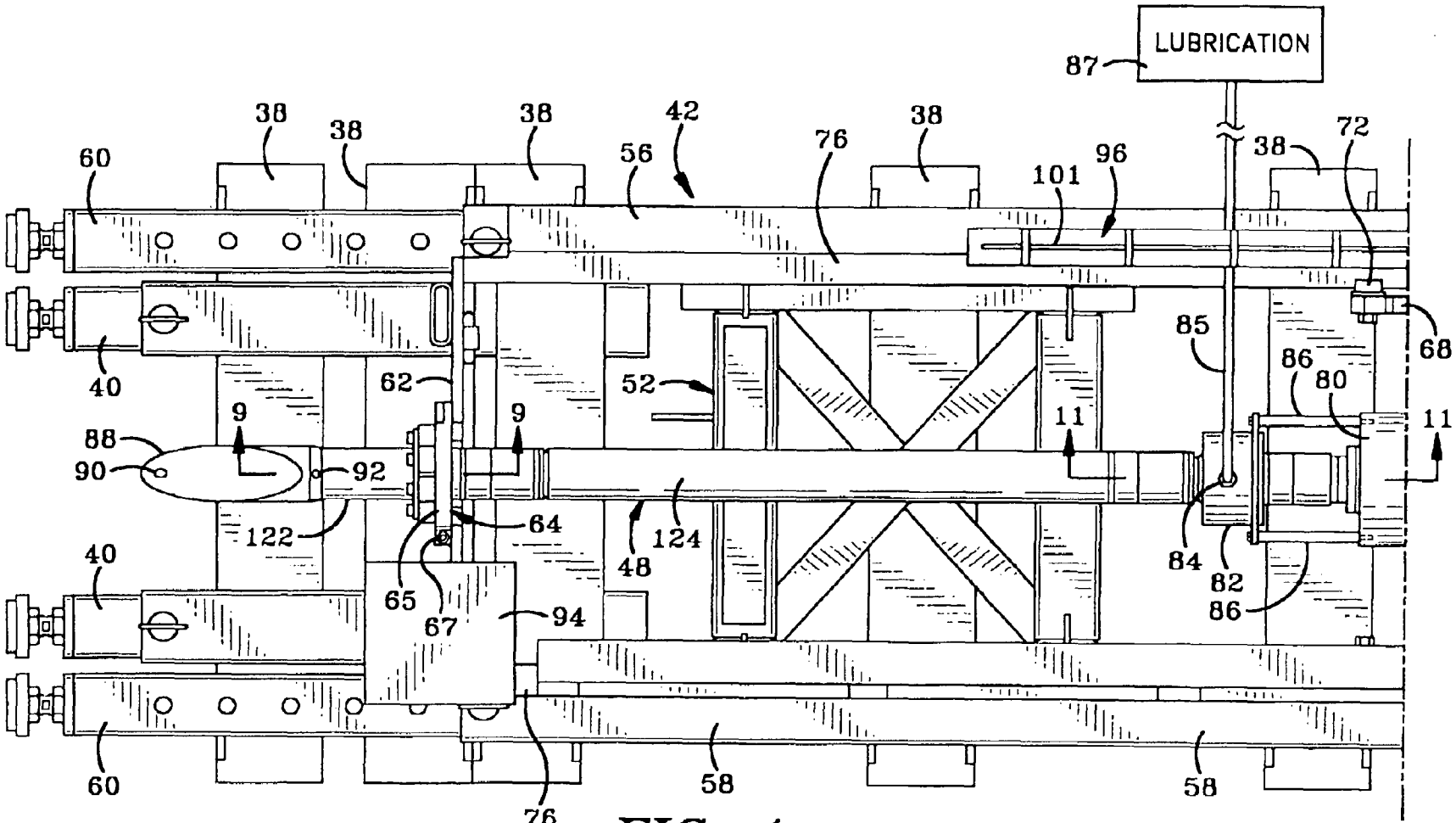
FIG. 4 is an enlarged top plan view of a front section of the pilot tube drive assembly.

Referring to FIGS. 3-4, assembly 42 includes front and rear mounting assemblies 52 and 54 which also serve as supports providing rigid structure extending axially across the width of assembly 42. Assemblies 52 and 54 are seated on rails 36 of frame 12 when assembly 42 is mounted on frame 12. A pair of longitudinally extending parallel spaced rails 56 and 58 are rigidly mounted on assemblies 52 and 54 and extend along most of the length of assembly 42. Adjustable stabilizing poles 60 are telescopically mounted respectively within first and second rails 56 and 58 and are adjustable to provide force against ground 8 in the same manner as poles 40.

Figure 12:
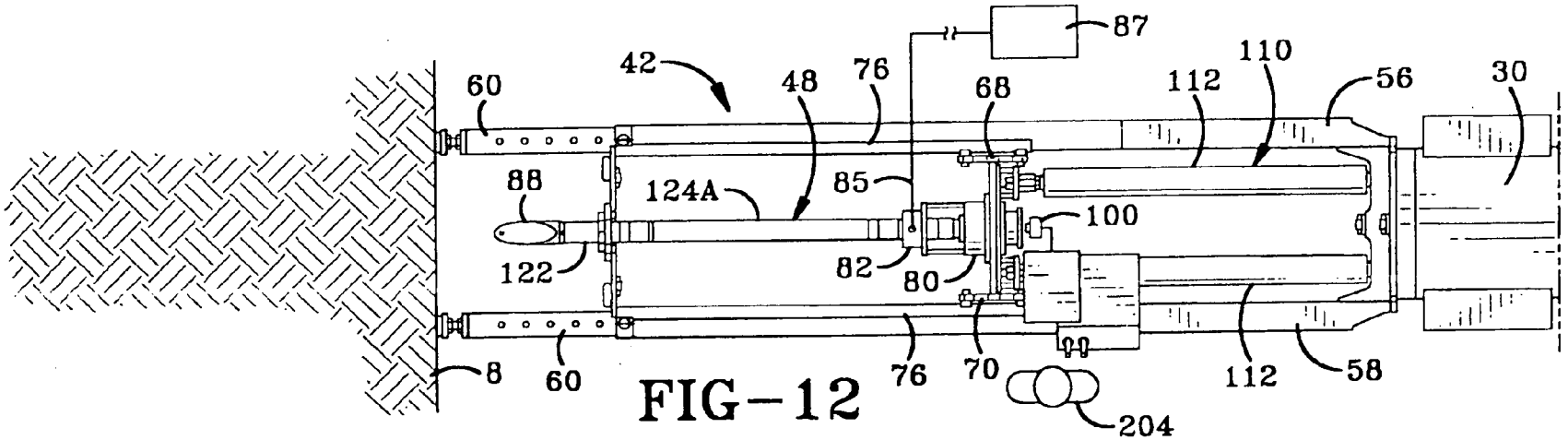
FIG. 12 is a top plan view of the pilot tube drive assembly prior to formation of the pilot hole.

A rigid front cross member 62 extends between and is connected to each of rails 56 and 58 adjacent the front thereof with a front pilot tube support 64 mounted thereon centrally between rails 56 and 58. Support 64 includes a plurality of bearings which engage the pilot tube 48 to allow longitudinal movement of tube 48 as well as rotational movement of tube 48 about axis X to allow for the steering thereof. Rear plate 50 and associated structure attached thereto serve as a rear cross member for rigidly connecting rails 56 and 58 to one another at the rear of assembly 42. An intermediate cross member 66 extends axially between rails 56 and 58 and is supported respectively on rails 56 and 58 by first and second roller assemblies 68 and 70 (FIG. 12). Each roller assembly includes a pair of longitudinally spaced upper rollers 72 and longitudinally spaced lower rollers 74 which respectively rollingly engage upper and lower surfaces 76 and 78 of respective rails 56 and 58. Upper and lower surfaces 76 and 78 are parallel surfaces which extend longitudinally from the front of rails 56 and 58 to around the midway point between the front and rear of said rails. An electric guidance control motor 80 is mounted on cross member 66 for selectively rotating pilot tube 48 in either direction about axis X.

In accordance with a feature of the invention, a lubricant feed swivel 82 having a lubricant inlet 84 is mounted on motor 80 by a pair of spaced mounting rods 86 extending forward from motor 80. Swivel 82 is connected to pilot tube 48 and thus serves as an engaging member for drivingly engaging tube 48 during operation of assembly 42. As shown in FIG. 4, inlet 84 of swivel 82 is in fluid communication with a lubricant feedline 85 which is in fluid communication with a source 87 of lubricant, which is typically water. Source 87 includes a pump for pumping water. Swivel 82 receives water through inlet 84 to pump the water through pilot tube 48 and through a steering head 88 connected to the front of pilot tube 48, the water flowing out a forward exit opening 90 and a plurality of lateral exit openings 92. Swivel 82 is described in greater detail further below.

A crane stand 94 is mounted on the frame of assembly 42 for supporting a crane (not shown) used for lifting pilot tube segments into position for connecting the various segments to form pilot tube 48 during the process of jacking or driving tube 48 to form the pilot hole. A cord carrier 96 is mounted atop rail 56 and includes a plurality of links 98 which are pivotally connected to one another so that electrical cords 101 (FIG. 4) will not become tangled during the longitudinal driving of pilot tube 48. A support arm extends from cross member 66 to one of links 98 to provide support to the upper section of carrier 96. Electrical cord 101 is electrical communication with motor 80 and generator 26.

During the jacking or driving of pilot tube 48, a steering mechanism keeps tube 48 on line and grade using a theodolite which utilizes a camera 100 (FIGS. 2, 13) in electrical communication with a display monitor 102 which displays the view of the camera through pilot tube 48 of an illuminated LED target 104 (FIGS. 9-10) disposed within pilot tube 48 adjacent steering head 88. In order for camera 100 to view LED target 104, pilot tube 48 is hollow, as are the other structures intermediate camera 100 and target 104, such as motor 80 and swivel 82, in order to provide a line of sight Z (FIGS. 5, 8, 9, 11) passage between camera 100 and target 104. A guidance control unit 106 is mounted on rail 58 and includes manually operable controls 108 typically in the form of joysticks in electrical communication with motor 80 in order to send a signal to motor 80 to control rotation of pilot tube 48.

Assembly 42 includes a continuous stroke drive mechanism 110 comprising a pair of hydraulic actuators in the form of piston-cylinder combinations 112 powered by pump 28 (FIG. 1). Each combination 112 includes a cylinder 114 and a piston 116 slidably received therein. Each cylinder 114 is mounted on the rear cross member adjacent plate 50 while each piston 116 is mounted on intermediate cross member 66. Pistons 116 extend and retract simultaneously along paths that are parallel to one another and substantially parallel to axis X of pilot tube 48. Combinations 112 must provide a substantial amount of forward and reverse thrust. For example, the forward thrust produced by combinations 112 on one preferred embodiment has a maximum thrust of 280,000 pounds while the reverse thrust has a maximum thrust of 140,000 pounds. Combinations 112 are capable of a continuous stroke throughout the extension thereof and likewise during the retraction thereof. Drive mechanism 10 and other suitable drive mechanism s are described in further detail in the copending application entitled Method And Apparatus For Providing A Continuous Stroke Auger Boring Machine which is incorporated herein by referenced and filed concurrently herewith.

Pilot tube 48 is made up of a plurality of pilot tube segments which are connected end to end to sequentially increase the length of pilot tube 48 during the jacking process. Typically, all or nearly all of the pilot tube segments are of the same length and are interchangeable with one another. However, some of the pilot tube segments may be of a different length, such as the lead pilot tube segment 122, which is connected to steering head 88 and which is shorter than the standard pilot tube segments 124 connected sequentially behind segment 122. Lead pilot tube segment 122 has a length of roughly two feet while pilot tube segments 124 typically come in lengths of five feet although this may vary. More particularly, tube segments 124 have an end to end length L1 (FIG. 10) measured between the leading and trailing ends 126 and 128 thereof. While length L1 is typically five feet as noted above, the tube segments may have a length of three feet, four feet or greater than five feet. If the lengths of the pilot tube segments are too short, they may became less practical for various reasons while tubes reaching greater lengths may become less desirable due to the substantial weight of the tubes and the additional length of the boring machine and the pit required for positioning the machine therein.

Figure 5:
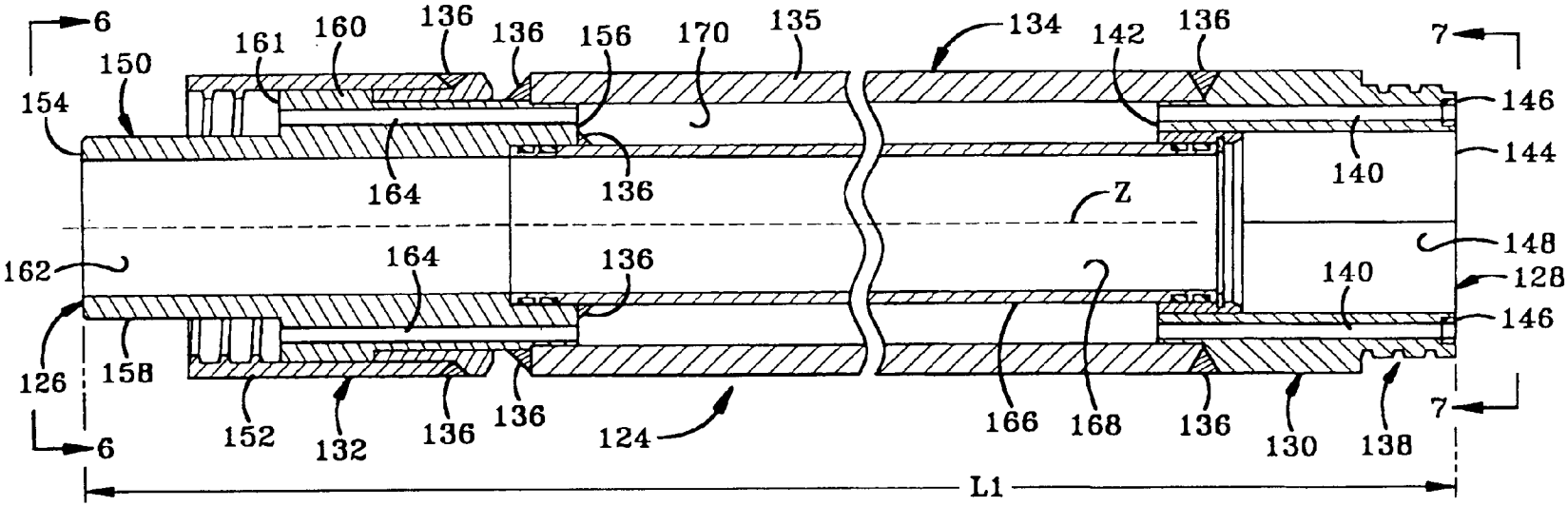
FIG. 5 is a fragmentary sectional view taken along the longitudinal axis of a pilot tube segment showing the internal structure thereof and the coupling members.
Figure 7:
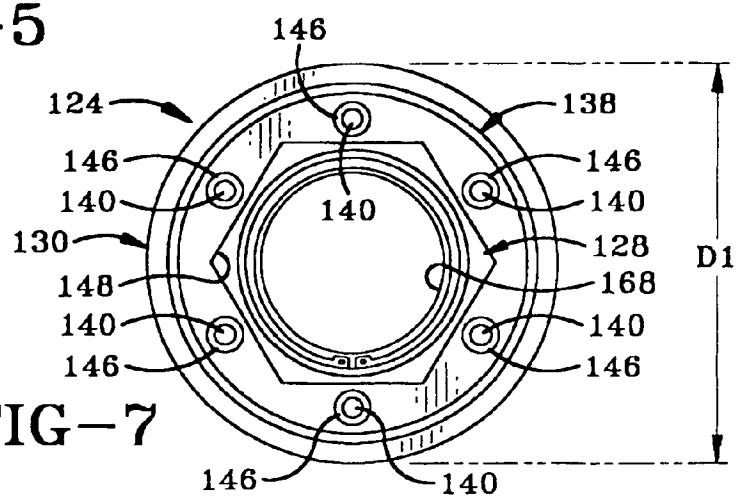
FIG. 7 is an end elevational view taken on line 7-7 of FIG. 5 showing the other coupling member.
Figure 6:
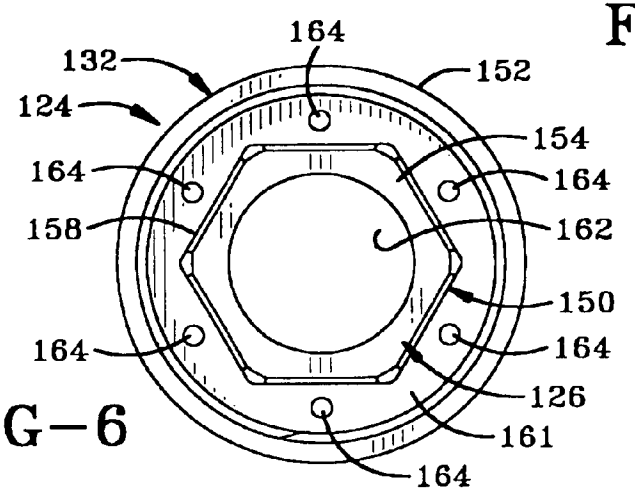
FIG. 6 is an end elevational view taken on line 6-6 of FIG. 5 showing one of the coupling members.

As noted previously, and in accordance with the invention, pilot tube 48 is configured to allow a lubricant such as water to flow therethrough to steering head 88. The various structures including lubricant passages of pilot tube 48 are discussed with reference to FIGS. 5-7. More particularly, FIG. 5 shows a sectional view of a pilot tube segment 124 which in part shows the lubricant passages therethrough. Tube segment 124 is formed of a heavy duty metal with sufficient strength to withstand the thrust forces noted earlier. Segment 124 has first and second coupling ends or members 130 and 132 having a mating configuration with one another so that a first coupling member 130 of tube segment 124 may be coupled to a second coupling member 132 of another tube segment 124 to form pilot tube 48 during the process of driving the pilot tube. Members 130 and 132 are respectively connected at either end of a central section 134 by welds, which are indicated generally at 136 in various places. Central section 134 includes an outer pipe 135 and inner pipe 166. Each of outer pipe 135 and coupling members 130 and 132 have an outer diameter D1 (FIG. 7) which is also the diameter of pilot tube 48. In the exemplary embodiment, diameter D1 is about 5.0 inches although pilot tubes having a diameter of 4.5 inches are common and the diameter typically ranges from 4 inches to 6 inches. First coupling member 130 includes an externally threaded end portion 138 stepped inwardly from the outer surface defining diameter D1 thereof. Six lubricant passages 140 are formed in first coupling member 130 and extend from a leading end 142 thereof to a trailing end 144 thereof. Passages 140 are circumferentially equally spaced from one another as shown in FIG. 12. Each passage 140 has a counter bore adjacent end 144 in which a respective seal 146 is disposed. A central hexagonal opening 148 extends inwardly from trailing end 144 with passages 140 disposed radially outwardly thereof.

Second coupling member 132 includes an inner member 150 and an outer member in the form of an internally threaded collar 152 which is rotatably mounted on inner member 150 and configured to threadably engage the threaded portion 138 of a coupling member 130 of another pilot tube segment 124. Inner member 150 has a leading end 154 and a trailing end 156 and includes a hexagonal segment 158 which is receivable within and has a mating configuration with hexagonal opening 148 of first coupling member 130. Inner member 150 includes an annular wall 160 which is connected to a trailing end of segment 158 and extends radially outwardly therefrom. Wall 160 has a leading end 161 which extends perpendicular to segment 158. A central passage 162 extends from leading edge 154 to trailing edge 156 and six lubricant passages 164 are disposed radially outwardly of passage 162 and are circumferentially evenly spaced from one another in order to align with passages 140 when a first and second coupling member 130 and 132 are joined to one another.

Inner pipe 166 defines a central passage 158 which communicates with passage 162 and opening 148 so that a through passage is formed in segment 124 extending from leading edge 126 to trailing edge 128 thereof. Inner pipe 166 is connected to inner member 150 and first coupling member 130 in a manner to provide an annular lubricant passage 170 between inner pipe 166 and outer pipe 135.

Figure 8:
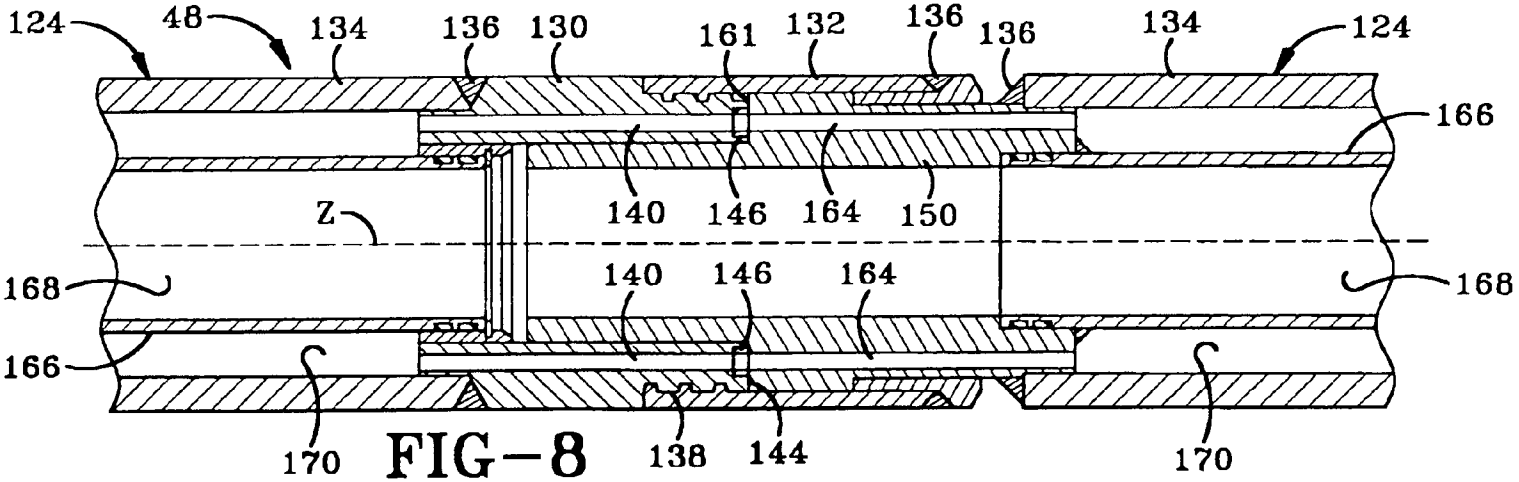
FIG. 8 is a sectional view taken on line 8-8 of FIG. 15 showing the connection between the pilot tube segments via the connection of the coupling members.

Passage 170 communicates with the trailing ends of lubricant passages 164 and the leading ends of lubricant passages 140 in order to provide a lubricant passage through pilot tube segment 124 from leading edge 126 to trailing edge 128. Other than the communication of passage 170 with passages 164 and 140, passage 170 is sealed so that it does not communicate with central passage 168 or to the outer surface of outer pipe 135. Passages 162 and 168 and opening 148 provide for line of sight Z extending therethrough along which camera 100 is able to view LED target 104. FIG. 8 shows two pilot tube segments 124 connected via the coupling of members 130 and 132 via the threaded engagement there between. Passages 140 are aligned respectively with passages 164 with seals 146 performing a seal against leading end 161 of inner member 150.

Figure 9:
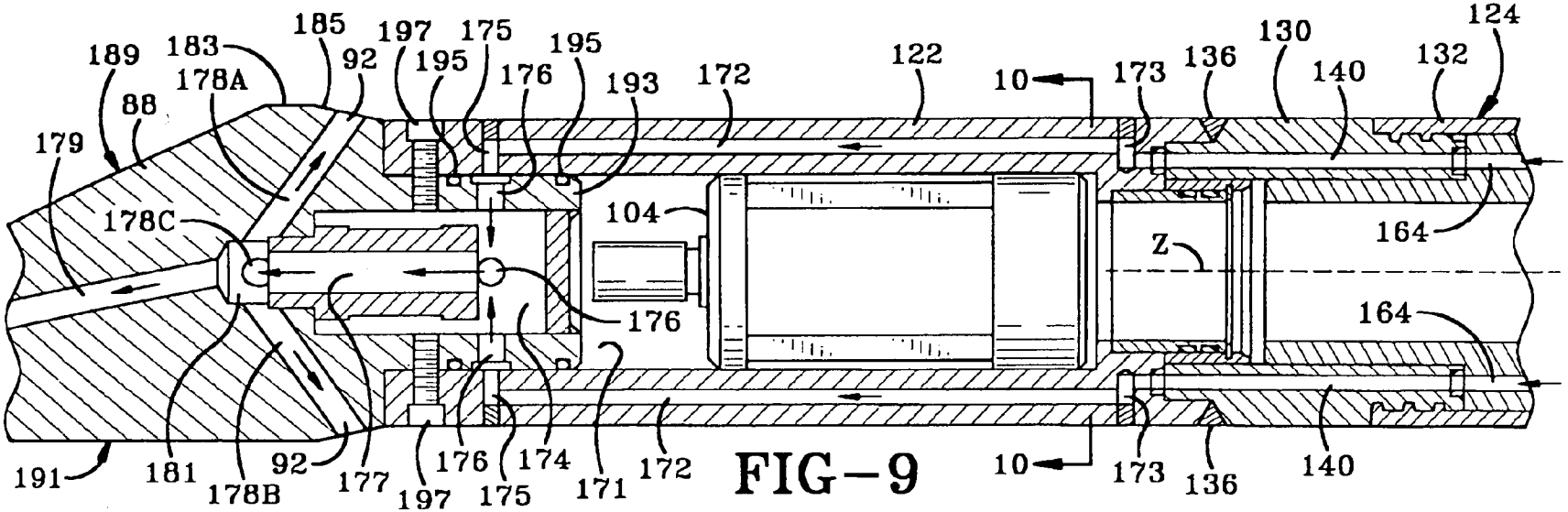
FIG. 9 is a fragmentary sectional view taken on line 9-9 of FIG. 4 showing a leading pilot tube segment with the LED target disposed therein and connected to the steering head and a trailing pilot tube segment.
Figure 10:
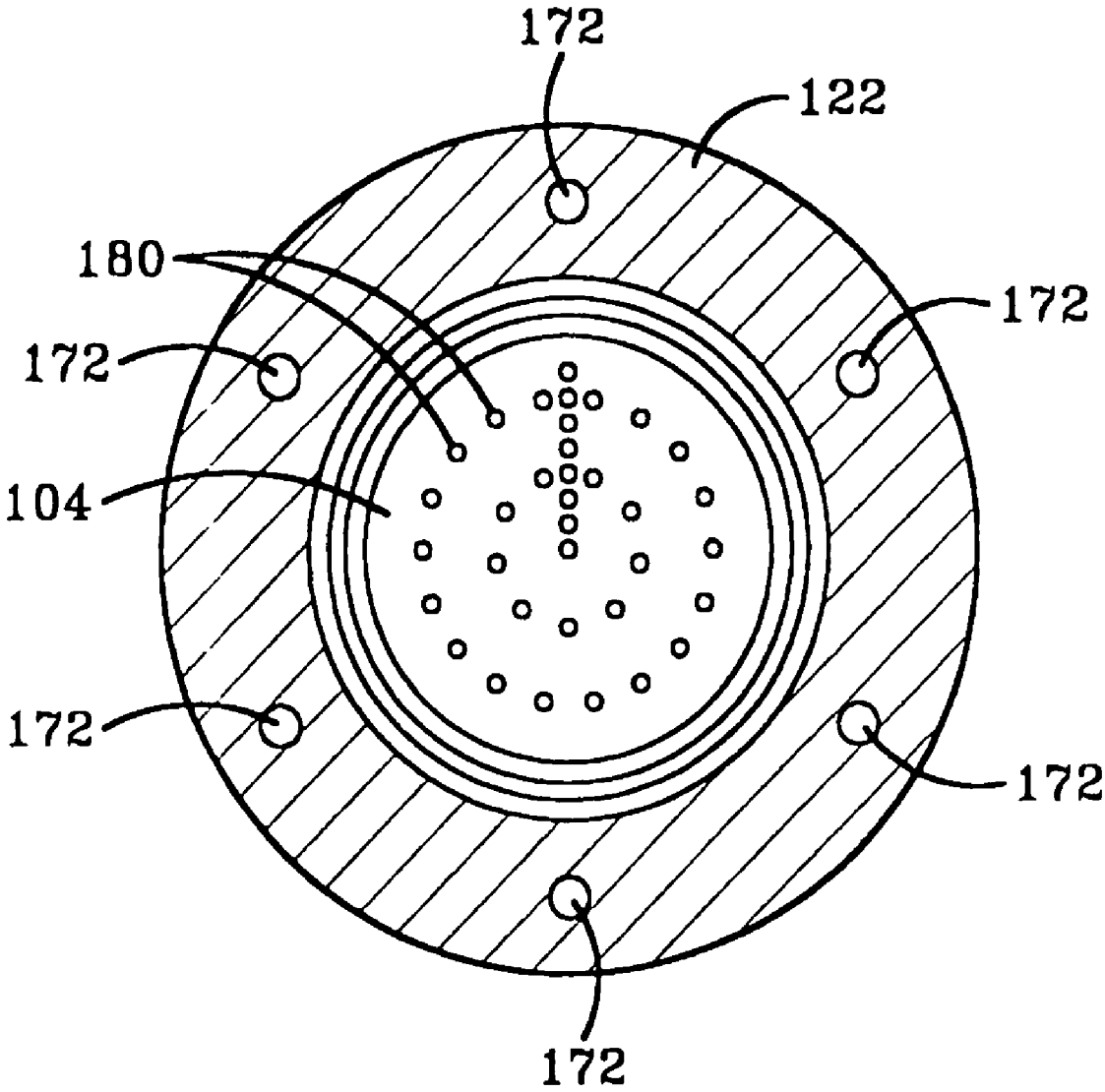
FIG. 10 is a sectional view taken on line 10-10 of FIG. 9 showing the LED target within the leading pilot tube segment.

FIG. 9 shows additional passages in pilot tube 48 allowing for a flow of lubricant therethrough to steering head 88. More particularly, FIG. 9 shows that lead pilot tube segment 122 includes a first coupling member 130 which is connected to a second coupling member 132 of a pilot tube member 124 to align the respective passages thereof. Unlike pilot tube segment 124, segment 122 is shorter and configured to carry target 104 therein, and thus does not include an annular central passage such as passage 170 of segment 124. Instead, six lubricant passages 172 are formed therethrough in a manner similar to passages 140 and passages 164 in order to allow communication with passages 140 of coupling member 130. However, passages 172 are positioned slightly radially outwardly of the respective passages 140 due to the increased diameter of a central passage 171 formed in lead pilot tube segment 122 for accommodating therein target 104. Thus, passages 172 adjacent the respective trailing ends thereof extend radially inwardly at short sections 173 thereof. Likewise, passages 172 extend radially inwardly at the respective leading ends thereof at short sections 175.

Figure 9A:
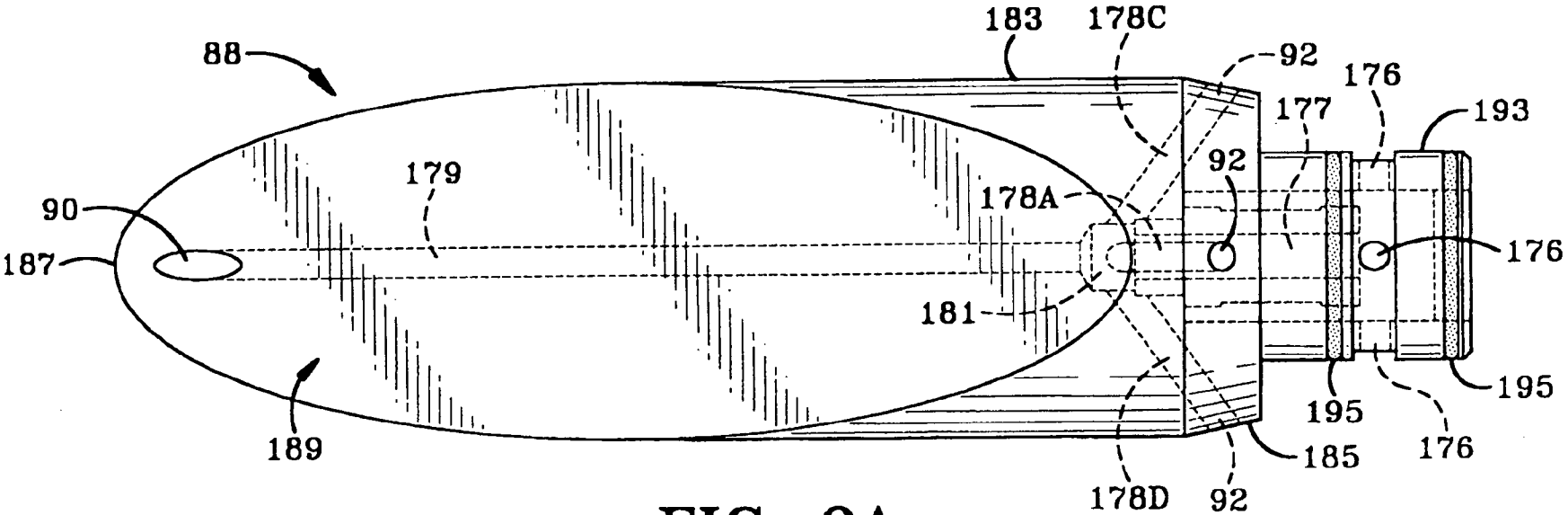
FIG. 9A is a top plan view of the steering head showing the lubrication passages in dashed lines.

Passages 172 merge into a central chamber 174 formed in the rear portion of steering head 88 via respective passages 176 which extend radially outwardly from chamber 174 and communicate with sections 175. Several other passages are formed in steering head 188 downstream of central chamber 174 which communicate with the outer surface of steering head 88 via exit openings 90 (FIGS. 3, 4, 14) and 92. More particularly, a central passage 177 extends forward from chamber 174 and splits into four lateral passages 178A-D (FIGS. 9-9A) and a forward passage 179. More particularly, each of passages 178 and 179 branch off from a central chamber 181 immediately downstream from passage 177. As shown in FIG. 9, passage 178A angles upwardly and rearwardly from chamber 181 to the outer surface of steering head 88 and passage 178B angles downwardly and rearwardly from chamber 181 to the outer surface of steering head 88. As shown in FIG. 9A, passage 178C extends laterally and rearwardly from chamber 181 to the outer surface of steering head 88 toward one side of head 88 and passage 178D angles laterally outwardly and rearwardly from chamber 181 to the outer surface of steering head 88 on the opposite side from passage 178C.

Steering head 88 has a maximum diameter at the location indicated at 183 in FIG. 9 and tapers rearwardly and inwardly at a tapered section 185. Each of passages 178 communicates with the outer surface of steering head 88 at respective openings 92 formed in tapered section 185 and thus behind the maximum diameter region 183. Front passage 179 is centered as viewed from above in FIG. 9A and angles forward and downwardly from chamber 181 as shown in FIG. 9 through the outer surface of steering head at opening 90. More particularly, steering head 88 has a leading tip 187 (FIGS. 9A, 14) and a flat and generally oval shaped forward-facing steering face 189 which is configured to engage soil 8 and facilitate steering of pilot tube 48 therethrough when rotated by motor 80. Steering face 189 angles rearwardly from tip 187 to an opposite side of steering head 88 to terminate at maximum diameter region 183. Opposite steering face 189, steering head 88 has a straight outer surface 191 which is substantially parallel to the outer surface of pilot tube 48 and a path of travel of tube 48 when being driven. Thus, opening 90 is formed on steering face 189 adjacent and rearwardly of tip 187. Steering head 88 further includes a neck 193 which is stepped inwardly from tapered section 185 and disposed within passage 171 of pilot tube segment 122. A pair of annular seals 195 make a seal between neck 193 and the inner surface of segment 122 defining passage 171 respectively forward of and rearward of passages 176. A plurality of bolts 197 threadably engage neck 193 to secure steering head 88 to the front of tube segment 122. FIG. 9 further shows that lead tube segment 122 defines a central passage providing for line of sight Z therethrough to provide a clear view of illuminations 180 (FIG. 10) of target 104.

Figure 11:
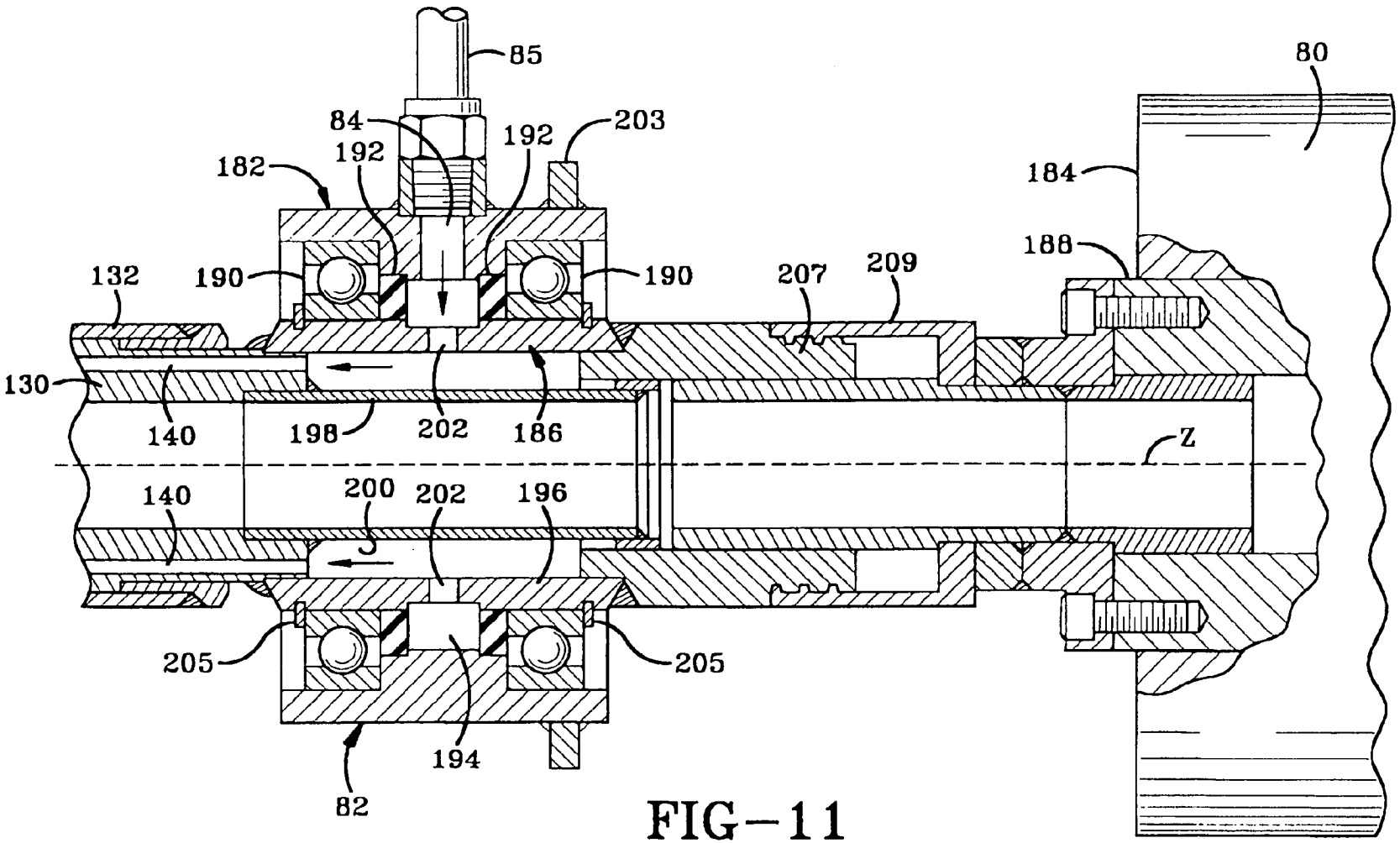
FIG. 11 is a sectional view taken on line 11-11 of FIG. 4 showing the lubricant feed swivel.

FIG. 11 shows a sectional view of the lubricant feed swivel 82 and portions of motor 80 along with the connecting members associated therewith. FIG. 11 illustrates a central passage through motor 80, swivel 82 and the connecting structure associated therewith so that line of sight Z is maintained. FIG. 11 also illustrates the initial portions of the lubricant passage within pilot tube 48 and the connection of swivel 82. More particularly, feed swivel 82 includes a stationary annular housing 182 which is mounted on a stationary housing 184 of motor 80 via rods 86 (FIG. 3) which are mounted on an annular flange 203 of housing 184. Swivel 82 also includes a rotatable portion 186 which is connected to a rotatable drive 188 of motor 80 to rotate therewith. Portion 186 is rotatably mounted within housing 182 by a pair of longitudinally spaced ring bearings 190 with a pair of spaced annular seals 192 disposed between bearings 190 and respectively abutting said bearings. V-pack seals have been found to work well in this application although seals 192 may be any seal suitable for the purpose. A pair of annular retaining clips 205 are disposed respectively in front of the forward bearing 190 and rearwardly of the rear bearing 190 respectively in abutment therewith to retain bearings 190 in position. Rotatable portion 186 includes a threaded portion 207 adjacent its trailing end which threadably engages the internal threads of a coupling collar 209 which is mounted on rotatable drive 188 of motor 80.

Seals 192 define there between an annular lubricant passage 194 which is in communication with inlet 84. Rotatable portion 186 includes outer and inner pipes 196 and 198 defining there between an annular lubricant passage 200. Outer pipe 196 defines a plurality of radially extending and circumferentially spaced lubricant passages 202 in fluid communication with annular passages 194 and 200. Thus, passages 140 of coupling member 130 are in communication with annular passage 200. The configuration of feed swivel 82 allows for the rotation of portion 186 while maintaining continuous fluid communication between passages 202 and annular passage 194. A first connecting member 130 is connected to outer and inner pipes 196 and 198 and extends forward therefrom to couple with a second coupling member 132 in order to provide connection with the remainder of pilot tube 48. The arrows in FIGS. 9 and 11 indicate the flow of lubricant through the various passages from swivel 82 through pilot tube 48 and steering head 88.

The operation of boring machine 10 is now described with reference to FIGS. 12-19. FIGS. 12-16 are shown without main frame 12 of machine 10 for simplicity. FIG. 12 shows assembly 42 prior to the jacking or driving of pilot tube 48 to form a pilot hole with an operator 204 preparing to begin operation of assembly 42. The pistons of piston cylinder combinations 112 are shown in a fully retracted position FIG. 12. Assembly 42 is operated to actuate combinations 112 in order to extend pistons 116 thereof to drive pilot tube 48 into ground 8 as indicated in arrow E in FIG. 13 to form the initial stages of a pilot hole 206. During the extension of pistons 116 and pilot tube 48, camera 100 senses or receives input from LED target 104 and relays the images of illuminations 180 on the monitor 102. Operator 204 views display monitor 102 in order to determine whether steering head 88 needs to be adjusted to maintain the line and grade of pilot tube 48. Operator 204 will use controls 108 in order to make any necessary adjustments, specifically rotating pilot tube 48 as indicated in arrow F in FIG. 13 via motor 80. For use with longer pilot holes, machine 10 may include additional steering control mechanisms, as described in further detail in the copending application entitled Auger Boring Machine With Two-Stage Guidance Control System which is incorporated herein by referenced and filed concurrently herewith.

Figure 13:
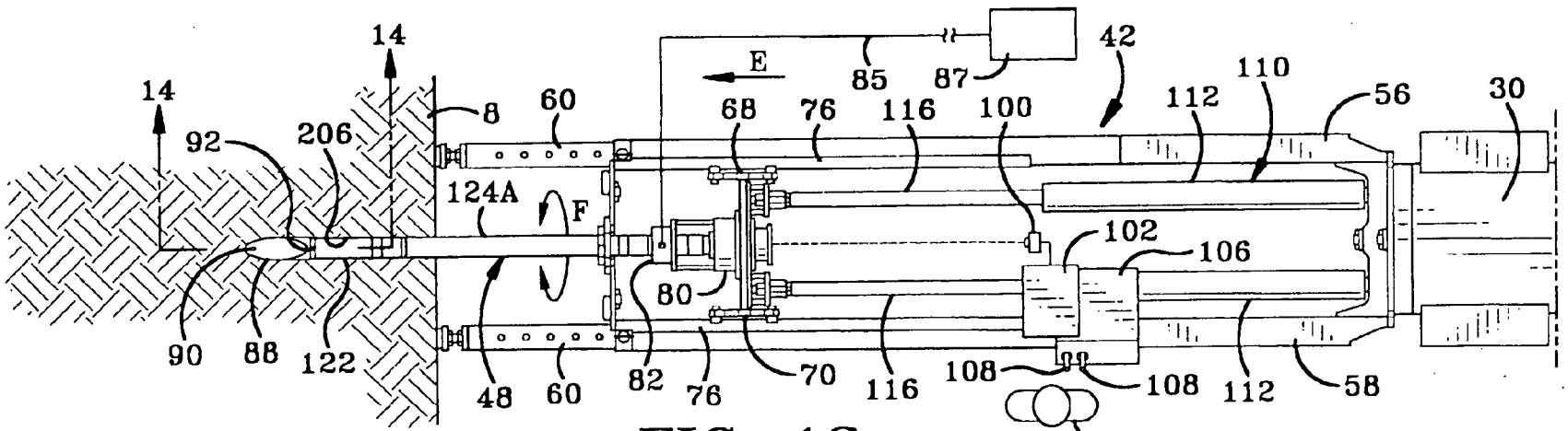
FIG. 13 is a top plan view of the drive assembly showing an extension of the hydraulic actuators to provide an initial stage of pilot hole formation and also showing the steering capability of the pilot tube.

Simultaneously with driving and steering pilot tube 48 and in accordance with invention, water is pumped through pilot tube 48 via swivel 82 to steering head 88 and through the exit openings thereof in order to facilitate the formation of pilot hole 206. At this early stage of pilot hole formation, only one of the standard size pilot tubes 124A is being used, as shown in FIGS. 12 and 13. Drive mechanism 110 thus drives pilot tube 48 for the entire length of tube segment 124A or farther, while the frame of assembly 42 remains stationary and preferably with a single continuous stroke of pistons 116. Likewise, roller assemblies 68 and 70 travel along surfaces 76 and 78 this distance and pistons 116 extend this distance as well.

Figure 14:
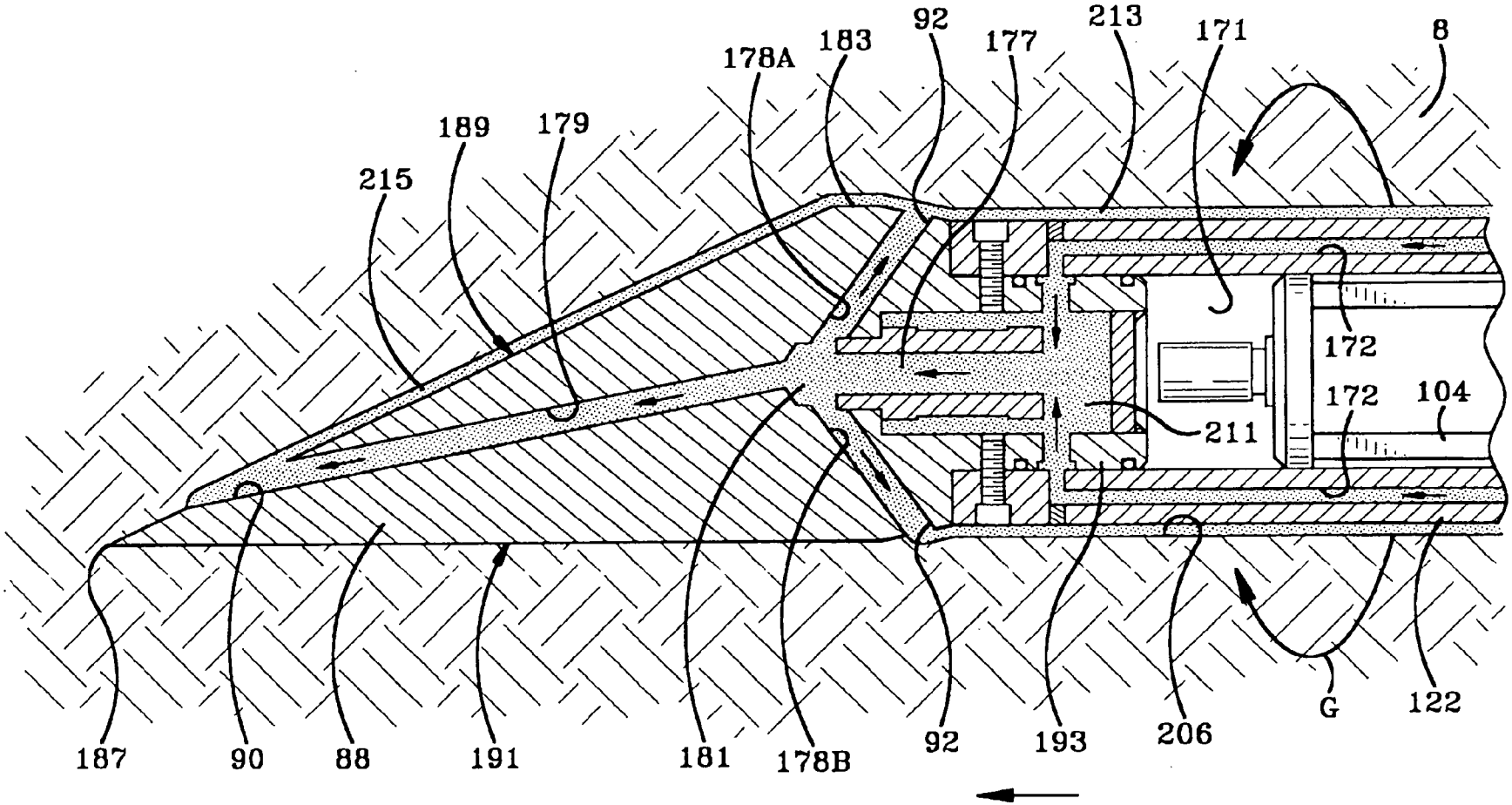
FIG. 14 is a sectional view taken on line 14-14 of FIG. 13 showing the flow of lubricant through the steering head and around the outer surface of the pilot tube.
Figure 15:
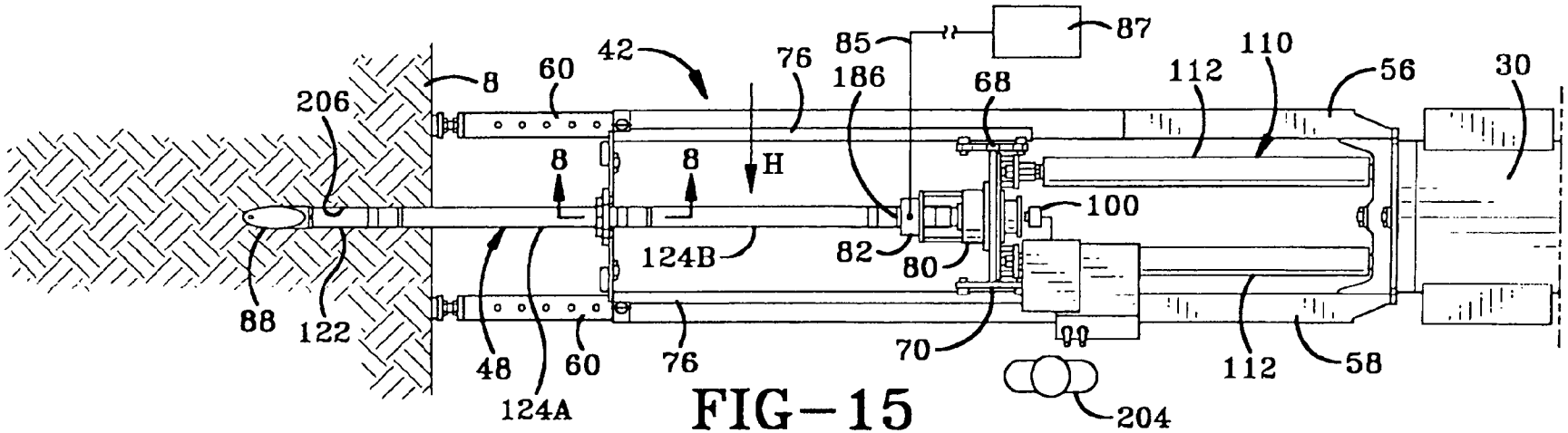
FIG. 15 is similar to FIG. 13 and shows the subsequent pilot tube segment connected to the previously driven pilot tube segment and the drive mechanism.
Figure 16:
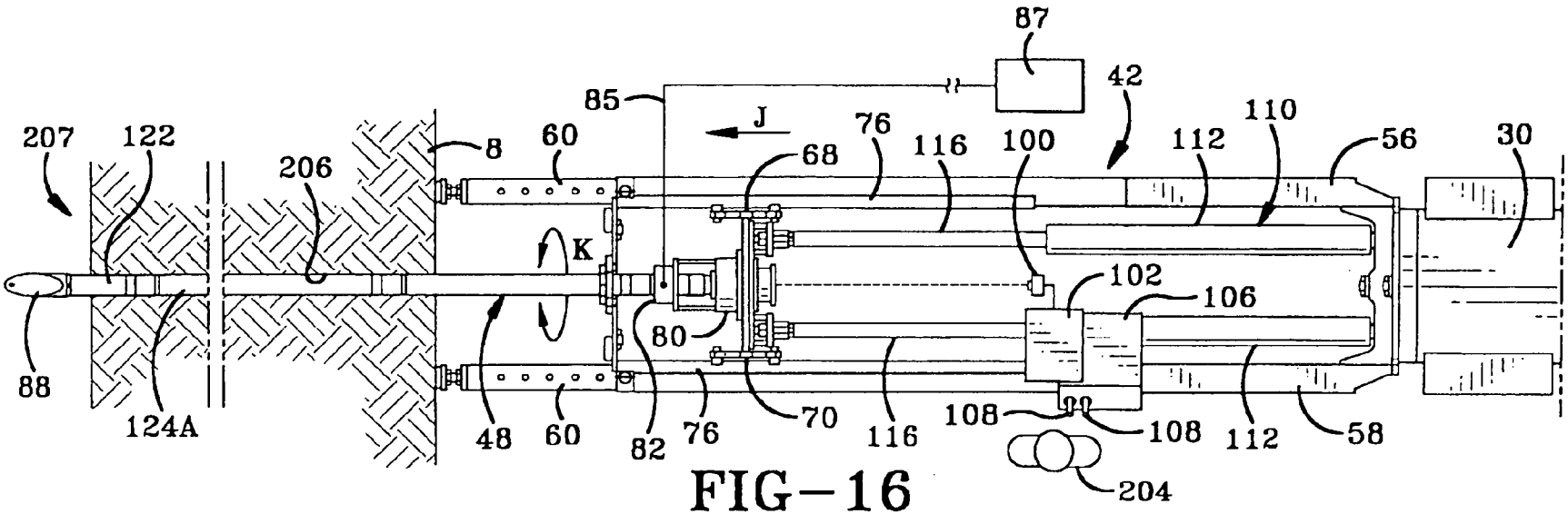
FIG. 16 is similar to FIG. 15 and shows the extension of the hydraulic actuators of the drive mechanism to drive the pilot tube with the newly installed pilot tube segment thereof to lengthen the pilot hole.

Further regarding the operation of the lubrication system of the present invention and with reference to FIG. 14, lubricant typically in the form of water 211 flows through pilot tube 48 and steering head 88 as indicated by the various arrows within the passages previously described. Water 211 thus flows forward from passages 179 out of opening 90 and rearwardly along steering face 189. Water also flows through the various passages 178 and out of opening 92 to form a rearwardly flowing sheath 213 of water which surrounds or substantially surrounds the outer surface of pilot tube 48. Sheath 213 of water thus substantially reduces the friction between the outer surfaces of tube 48 and soil 8 during the formation of pilot hole 206. This reduction in friction thus facilitates the forward movement of pilot tube 48 and its rotation as indicated at arrow G in FIG. 14. In addition, a layer 215 of water which forms along steering face 189 helps reduce the frictional engagement between face 189 and soil 8 during the formation of the pilot hole 206. Water 211 will also carry some of soil 8 entrained therein rearwardly along pilot tube 48 and into pit 6.

Once the initial driving of tube 48 is performed, pistons 112 are retracted and a second pilot tube segment 124B is positioned and connected to tube segment 124A and rotatable portion 186 of swivel 82 as indicated at arrow H (FIG. 15) in preparation for additional driving of tube 48. Drive mechanism 110 is then operated to extend piston 116, roller assemblies 68 and 70 and pilot tube 48 including segments 124A and B to lengthen pilot hole 206. Once again, this is achieved in a single continuous stroke as indicated at arrow J in FIG. 16 while operator 204 provides any rotational adjustment to steering head 88 as indicated at arrow K. Most preferably, the distance that drives mechanism 110 drives tube 48 is greater than the length of the pilot tube 124B to be inserted in order to make sufficient room for the coupling thereof subsequent to retraction of pistons 116. The pattern of adding tube segments and continuing to drive pilot tube 48 goes on until the pilot hole is completed or more particularly so that the pilot tube 48 extends out of ground 8 into a space which may be another pit 207 where sections of pilot tube 48 may be removed as the auger boring operation is underway and thus moves pilot tube 48 gradually forward.

Figure 17:
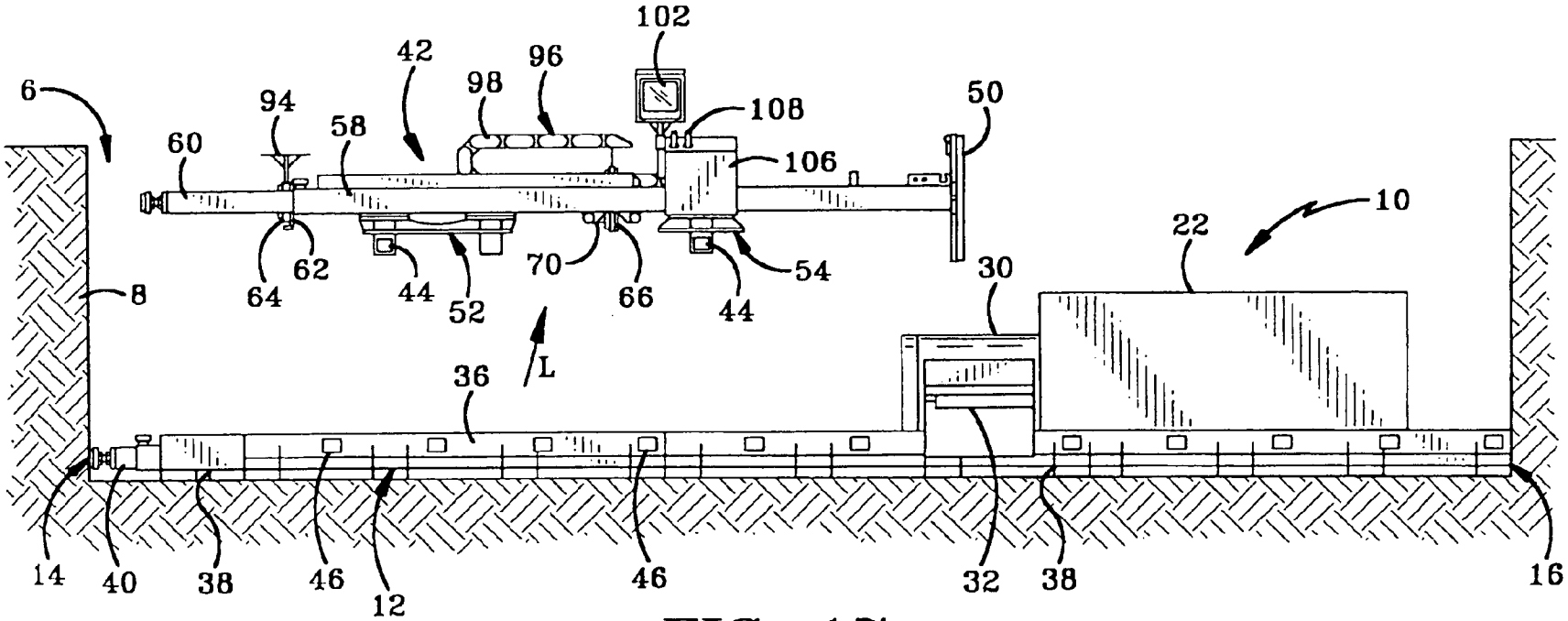
FIG. 17 is a side elevational view of the boring machine showing the pilot tube guidance and drive mechanism being removed from the frame of the auger boring machine.
Figure 19:
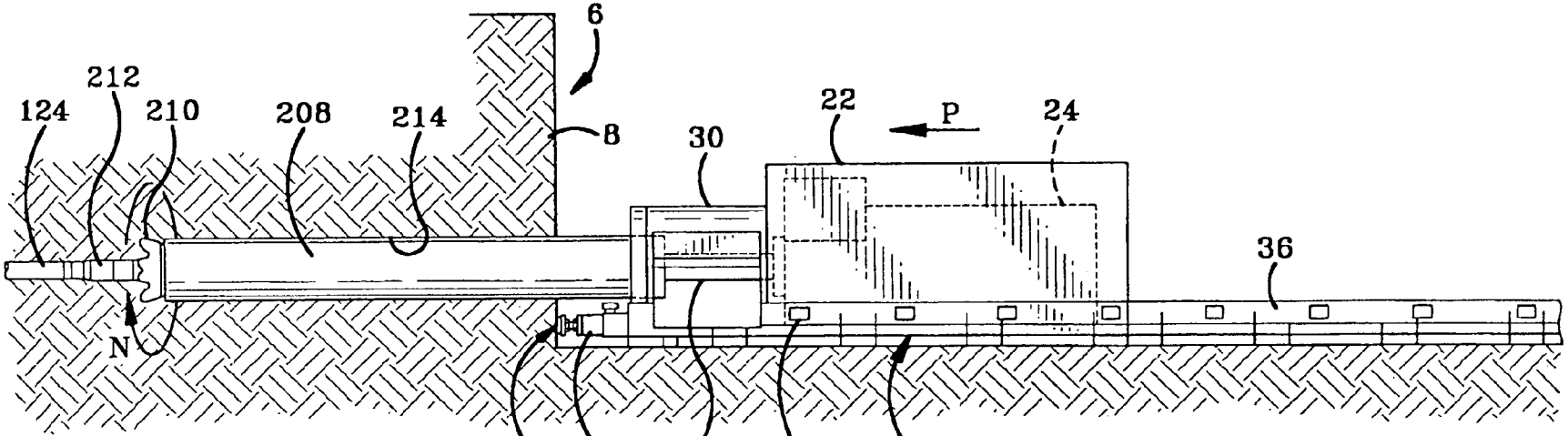
FIG. 19 is similar to FIG. 18 and shows the auger boring an enlarged diameter hole as it follows the pilot tube.

Once pilot hole 206 is completed, assembly 42 is removed from frame 12 of auger boring machine 10 as indicated at arrow L in FIG. 17. As shown in FIG. 18, auger 34 is then connected to output shaft 32 along with the pipe or casing 208 in which auger 34 is disposed and cutting head 210 connected to the front of auger 34. A swivel 212 is also connected to the trailing end of pilot tube 48 and the front of cutting head 210 to allow for the rotation of auger 34 and cutting head 210 without rotating pilot tube 48. Swivel 212 is described in greater detail in the copending application Method of Installing Large Diameter Casing and Swivel For Use Therewith which is incorporated herein by referenced and filed concurrently herewith. Cutting head 210 and casing 208 has a diameter D2 which is substantially larger than that of the diameter D1 (FIG. 17) of pilot tube 48. As shown in FIG. 19, engine 24 is then operated to rotate output shaft 32, auger 34 and cutting head 210 (arrow N) as engine 24 moves forward on rails 36 with auger 34 as indicated at arrow P to form a larger diameter hole 214 in which casing 208 will be disposed to form underground piping. Auger 34 carries soil cut by cutting head 210 rearwardly to discharge from its trailing end so that it can be removed from pit 6. Additional casings 208 with augers 34 disposed therein are connected in end to end fashion to increase the length of the pipe to be laid, each casing 208 being welded to the subsequent casing 208. It is noted that engine 24 serves as a single power source for operating auger 34 as well as for powering the drive mechanism of the pilot tube control and guidance assembly via generator 26 and hydraulic pump 28 (FIG. 2), as described in further detail in the copending application entitled Auger Boring Machine With Included Pilot Tube Steering Mechanism which is incorporated herein by referenced and filed concurrently herewith.

Figure 20:
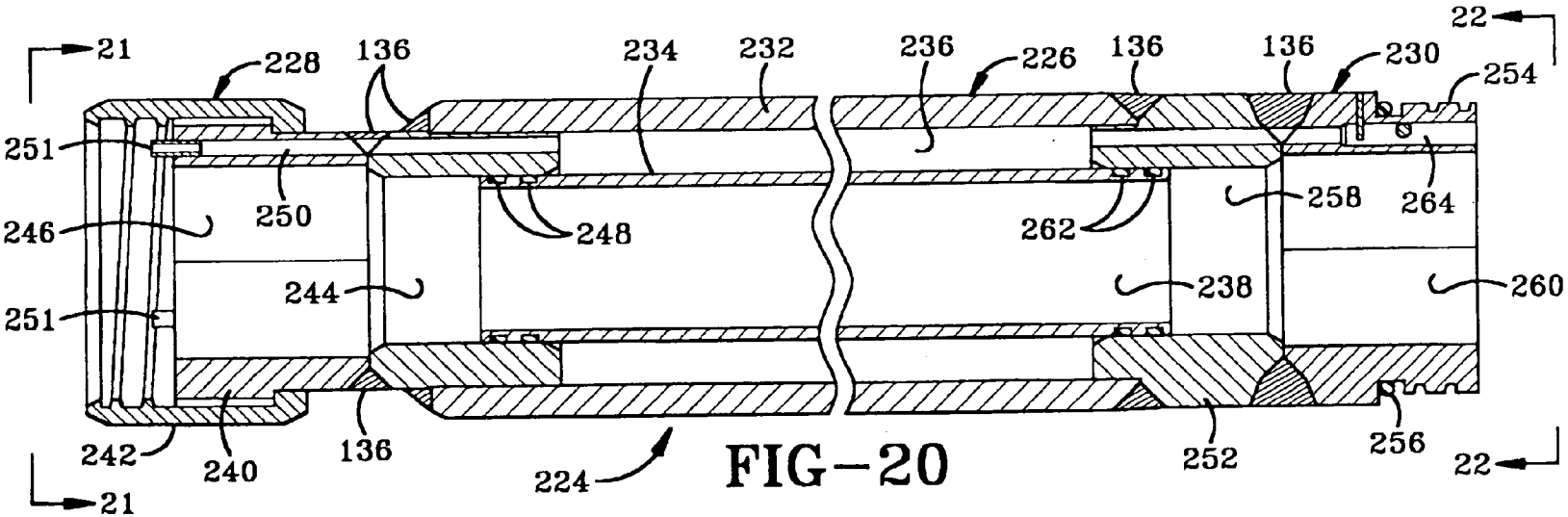
FIG. 20 is a sectional view similar to FIG. 5 showing a second embodiment of a pilot tube segment.
Figure 22:
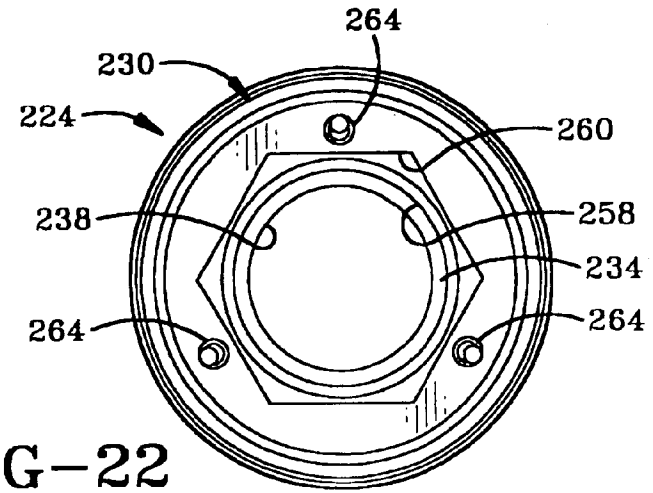
FIG. 22 is an end elevational view taken on line 22-22 of FIG. 20.
Figure 21:
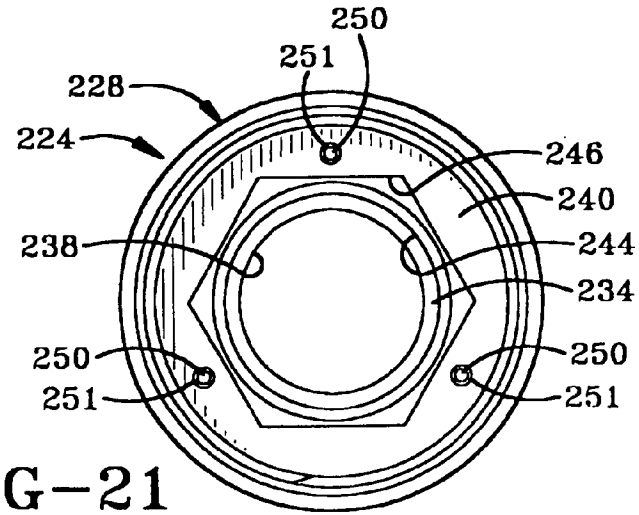
FIG. 21 is an end elevational view taken on line 21-21 of FIG. 20.

Referring to FIGS. 20-22, a second embodiment of a pilot tube segment 224 is described. Segment 224 is similar to segment 124 except for the structures adjacent the ends thereof. Segment 224 includes a central section 226 and first and second coupling members 228 and 230 connected to opposite ends thereof. Central section 226 includes a cylindrical outer pipe 232 and a concentric cylindrical inner pipe 234 which define therebetween an annular passage 236 which extends substantially the full length of central section 226. Inner pipe 234 defines a central passage 238 through which the line of sight Z passes.

First coupling member 228 includes an annular member 240 rigidly mounted on outer pipe 232. An internally threaded collar 242 is rotatably mounted on annular member 240 in a manner similar to that of collar 152 of coupling member 132. Annular member 240 has a cylindrical outer surface a portion of which is disposed within outer pipe 232 closely adjacent the inner surface of outer pipe 232. A central through passage is formed in annular member 240 and includes a cylindrical rear passage section 244 and a hexagonal front passage section 246 in communication therewith. The leading end of inner pipe 234 is received within rear passage section 244 with a pair of annular seals 248 circumscribing inner pipe 234 to form a seal with annular member 240. Three lubricant passages 250 are formed in annular member 240 which are disposed radially outwardly from the central passage thereof and spaced equally circumferentially. Passages 250 extend from the leading end to the trailing end of annular member 240 and communicate with annular passage 236. Three alignment tubes 251 are rigidly mounted respectively within passages 250 adjacent their leading ends and extend forward of the leading end of annular member 240.

With reference to FIGS. 20 and 22, second coupling member 230 includes an annular member 252 rigidly welded to outer pipe 232. Member 252 has an externally threaded section 254 adjacent its trailing end for threadably engaging an internally threaded collar 242 of another pilot tube segment 224. An annular seal 256 circumscribes a portion of annular member 252 forward of threaded section 254 for making a seal with collar 242 of another segment 224. A central through passage is formed in annular member 252 and includes a cylindrical front passage section 258 and a hexagonal rear passage section 260 in communication therewith. The trailing end of inner pipe 234 is received within section 258 and sealed therewith by a pair of annular seals 262. Three lubricant passages 264 are formed in annular member 252 radially outwardly of the central passage thereof and are circumferentially spaced equally from one another. Each passage 264 extends from the leading end to the trailing end of annular member 252 and communicates with annular passage 236.

Figure 23:
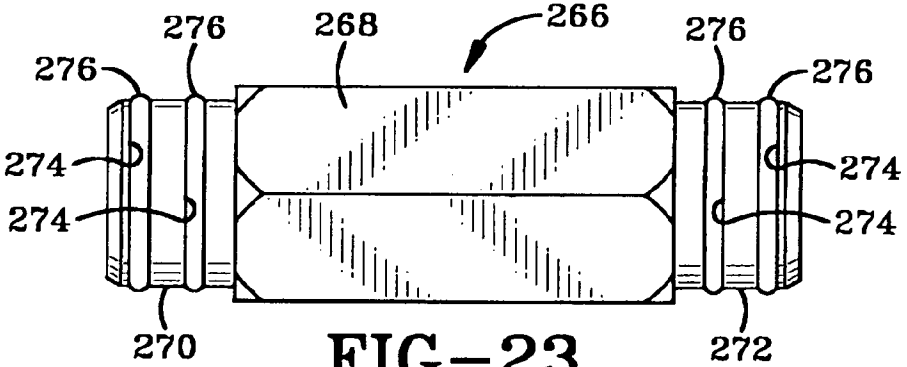
FIG. 23 is a side elevational view of the hexagonal connector.

Referring to FIG. 23, a pipe or connector 266 includes a hexagonal central section 268 and first and second cylindrical end sections 270 and 272 which are stepped inwardly from and connected to opposed ends of central section 268. A pair of annular grooves 274 is formed in each of sections 270 and 272 with respective annular seals 276 disposed therein.

Figure 24:
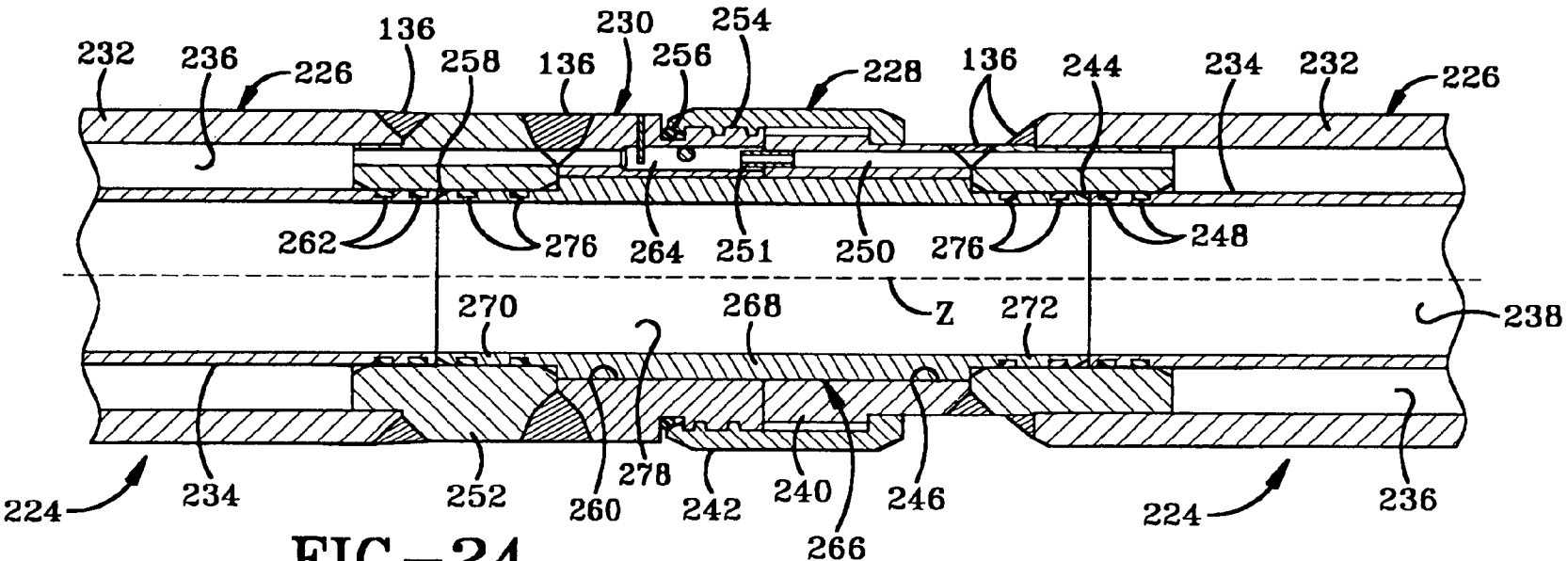
FIG. 24 is a sectional view similar to FIG. 8 showing the connection between the second embodiment of two pilot tube segments.

FIG. 24 shows two pilot tube segments 224 connected to one another. To assemble the two segments 224, alignment tubes 251 are aligned with respective passages 264 and extend respectively into said passages when the two segments 224 are joined to one another. Collar 242 is rotated to threadedly engage threaded section 254 to draw the two segments 224 together so that the leading end of annular member 240 abuts the trailing end of annular member 252 with the central passages aligned with one another. During the connection, connector 266 is slidably received within the central passages of annular member 240 and 252. More particularly, first cylindrical end section 270 is received within a portion of cylindrical front passage section 258 while a portion of hexagonal central section 268 is received within hexagonal rear passage section 260 of annular member 252. Seals 276 provide a seal between end section 270 and the inner surface of annular member 252. In a similar fashion, second end section 272 is received within cylindrical rear passage section 244 and a portion of hexagonal central section 268 is received within hexagonal front passage section 246 of annular member 240. Seals 276 form a seal between section 272 and the inner surface of annular member 240.

The hexagonal inner surface of central section 268 is of a mating configuration with the hexagonal inner surfaces of passage sections 246 and 260 so that connector 266 provides a torque drive between annular members 240 and 252 and thus between the two pilot tube segments 224. Connector 266 simply slides into the respective central passages of annular member 240 and 252 during connection and is slidably removable therefrom during disconnection of segments 224. Only the threaded connection between collar 242 and threaded section 254 secures the two tube segments 224 rigidly to one another. As with various other elements of the pilot tubes, a central through passage 278 is formed in connector 266 to provide for line of sight Z to extend therethrough. Passage 278 is thus in communication with the respective passages 238 of the adjacent pilot tube segments 224 when connected. Likewise, passages 250 are in communication respectively with passages 264.

Figure 25:
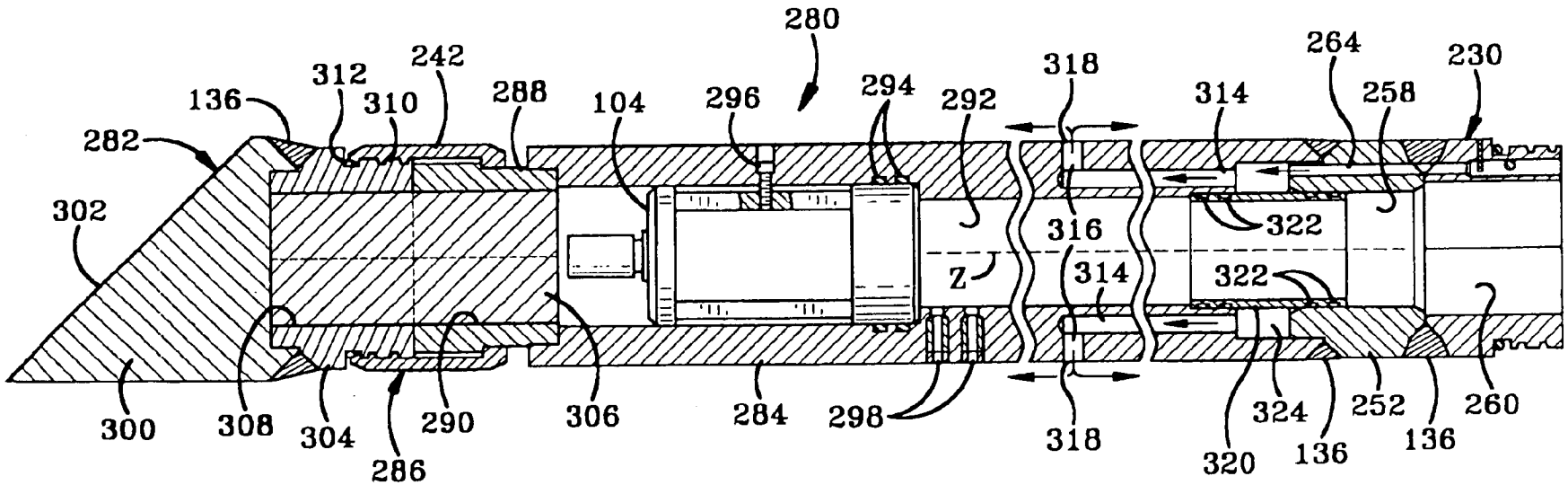
FIG. 25 is a sectional view of a second embodiment of a leading pilot tube segment with an alternate steering head attached thereto, and shows the flow of lubricant out of the exit openings thereof.

FIG. 25 shows a second embodiment of a leading pilot tube segment 280 with an alternate steering head 282 connected to the leading end thereof. Unlike the earlier embodiment in which lubrication passages are formed in the steering head, steering head 282 is a standard steering head while pilot tube segment 280 allows water to flow through the lubrication passages thereof to its outer surface. Segment 280 includes a central section 284 which is formed of a single cylindrical side wall as opposed to inner and outer concentric pipes. Connected to the trailing end of central section 284 is one of coupling members 230, which was described earlier with reference to pilot tube segment 224. Connected to the leading end of central section 284 is a steering head coupling member 286 for coupling with steering head 282. Coupling member 286 utilizes one of internally threaded collars 242 rotatably mounted on an annular member 288 which is rigidly connected to a leading end of central section 284. A hexagonal through passage 290 is formed in annular member 288 and extends from the leading end to the trailing end thereof.

A central through passage 292 is formed in the side wall of central section 284 and includes an interior chamber in which one of LED targets 104 is disposed. Central passage 292 communicates with hexagonal passage 290. A pair of annular seals 294 provide a seal between target 104 and the inner surface of the side wall of central section 284. An alignment screw 296 extends through a hole formed in the side wall of central section 284 and threadedly engages a portion of target 104 so that it is aligned properly within tube segment 280. A pair of check valves 298 are disposed within passages formed in the side wall of central section 284 to allow water to be blown out of central passage 292 if necessary to insure that there is a clear view of target 104 via line of sight Z, which extends through passage 292.

Steering head 282 includes a solid front body 300 with a steering face 302, an annular member 304 welded to the trailing end of front body 300 and a hexagonal drive shaft 306 which is received within a leading hexagonal cavity 308 extending forward from the trailing end of annular member 304. Annular member 304 adjacent its trailing end includes an externally threaded section 310 threadedly engaging collar 242. An annular seal 312 is disposed in a groove forward of threaded section 310 for making a seal with the leading end of collar 242. When steering head 282 is connected to pilot tube segment 280, the trailing portion of hexagonal drive 306 is received within hexagonal passage 290, which is of a mating configuration for providing a torque connection therebetween.

A plurality of lubricant passages 314 are formed in the side wall of central section 284 and extend forward from adjacent a trailing end thereof and terminate rearwardly of target 104. A plurality of short radially extending passages 316 extend outwardly from adjacent the trailing ends of passages 314 and have respective exit openings 318 on the outer surface of the side wall of central section 284. Passages 314 and 316 are respectively disposed radially outwardly of central passage 292 and circumferentially spaced equally from one another. A short inner pipe 320 extends from within central passage 292 of central section 284 into front passage section 258 of annular member 252. Several annular seals 322 provide for a seal between inner pipe 320 and each of central section 284 and annular member 252. An annular passage 324 is formed externally to inner pipe 320 and internally to a trailing portion of the side wall of central section 284 and communicates with passages 264 and 314.

Thus, the various passages formed in pilot tube segments 224 and 280 allow for water to be pumped therethrough and exit to the outer surface of leading pilot tube segment 280 adjacent steering head 282, as shown by the arrows within the passages. Typically, exit openings 318 are spaced only a foot or two rearwardly steering head 282. Thus, water may flow out of exit openings 318 forward and rearwardly thereof to provide a sheath of water around the pilot tube which provides lubrication as previously discussed with the earlier embodiment.

Thus, boring machine 10 provides a pilot tube drive assembly with a lubrication system which feeds lubricant typically in the form of water through the pilot tube and optionally through the steering head in order to facilitate the formation of the pilot hole, thus making the process substantially more efficient.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described..

The invention claimed is:

1. An apparatus comprising:

an auger boring machine pilot tube having leading and trailing ends and adapted for being driven into the earth to form a pilot hole to be followed by an auger;

at least one lubrication through passage formed in the pilot tube from adjacent the trailing end to adjacent the leading end;

a central line of sight passage formed in the pilot tube from the trailing end to adjacent the leading end so that the line of sight passage provides a clear line of sight through the pilot tube from the trailing end of the pilot tube to adjacent the leading end of the pilot tube; and at least one seal proximate the leading end whereby the pilot tube is configured to substantially prevent water from entering the line of sight passage during formation of the pilot hole.

2. The apparatus of claim 1 wherein the at least one lubrication passage comprises a plurality of through passages disposed radially outwardly of the line of sight passage.

3. The apparatus of claim 1 further comprising an illuminated target disposed within the line of sight passage adjacent the leading end of the pilot tube.

4. The apparatus of claim 3 further comprising a camera adjacent the trailing end of the pilot tube positioned to view the target through the line of sight passage.

5. The apparatus of claim 1 wherein the at least one lubrication passage comprises an annular passage circumscribing the line of sight passage.

6. The apparatus of claim 1 wherein the at least one lubrication passage comprises an annular passage.

7. The apparatus of claim 6 wherein the at least one lubrication passage comprises a plurality of first passages; and a plurality of second passages; and wherein the annular passage is disposed intermediate and communicates with the first and second passages.

8. The apparatus of claim 1 wherein the pilot tube comprises a first pilot tube segment having leading and trailing ends defining therebetween an axial direction; and further comprising a non-circular opening formed in the first pilot tube segment extending axially inwardly from one of its trailing and leading ends; and a non-circular axially extending projection on the other of the trailing and leading ends of the first pilot tube segment and of mating configuration with the non-circular opening.

9. The apparatus of claim 8 further comprising a line of sight passage formed in the first pilot tube segment through the non-circular projection and communicating with the non-circular opening.

10. The apparatus of claim 1 wherein the pilot tube comprises first and second pilot tube segments each having leading and trailing ends; and further comprising at least one first lubrication through passage formed in the first pilot tube segment from adjacent the trailing end of the first pilot tube segment to adjacent the leading end of the first pilot tube segment;

at least one second lubrication through passage formed in the second pilot tube segment from adjacent the trailing end of the second pilot tube segment to adjacent the leading end of the second pilot tube segment and in fluid communication with the at least one first lubrication passage when the first and second pilot tube segments are connected to one another.

11. The apparatus of claim 10 wherein the pilot tube has an axially extending axis extending from the leading end of the pilot tube to the trailing end of the pilot tube; and further comprising a first coupling member on the first pilot tube segment; a second coupling member on the second pilot tube segment; an externally threaded portion on one of the first and second coupling members; and an internally threaded collar on the other of the first and second coupling members and rotatable about the axis for threadably engaging the externally threaded portion.

12. The apparatus of claim 11 further comprising a projection on one of the first and second coupling members; and an opening formed in the other of the first and second coupling members for axially slidably receiving therein the projection in a manner to prevent relative rotation between the first and second pilot tube segments.

13. The apparatus of claim 12 further comprising a line of sight passage formed in the first and second pilot tube segments and extending through the projection.

14. The apparatus of claim 1 wherein the pilot tube comprises a steering head adjacent its leading end; and the at least one lubrication through passage extends through the steering head.

15. The apparatus of claim 1 wherein the pilot tube comprises a plurality of pilot tube segments connected in end to end fashion and comprising a leading pilot tube segment having an outer surface; and further comprising at least one exit opening on the outer surface in communication with the at least one through passage.

16. The apparatus of claim 1 wherein the pilot tube has an outer surface; and further comprising a steering head connected to the leading end of the pilot tube; and at least one exit opening on the outer surface of the pilot tube in communication with the at least one through passage adjacent and rearward of the steering head.

17. The apparatus of claim 1 further comprising a lubrication feed swivel comprising first and second portions mounted on one another with relative rotation therebetween, the second portion mountable on the trailing end of the pilot tube; at least one lubrication through passage formed in the first portion; and at least one lubrication through passage formed in the second portion in communication with the at least one through passage in the first portion and the at least one through passage in the pilot tube.

18. The apparatus of claim 17 further comprising a line of sight through passage formed in the second portion of the swivel in communication with the line of sight passage in the pilot tube so that the line of sight passages provide a clear line of sight through the second portion of the swivel and the pilot tube from adjacent the swivel to adjacent the leading end of the pilot tube during formation of the pilot hole.

19. The apparatus of claim 18 further comprising a target disposed within the line of sight passage of the pilot tube adjacent the leading end of the pilot tube; and a camera adjacent the swivel positioned to view the target through the line of sight through passage of the swivel and the line of sight passage of the pilot tube.

20. The apparatus of claim 17 wherein the at least one lubrication through passage in the second portion comprises a first annular passage in communication with the at least one passage in the pilot tube; and a transition passage in communication with and extending radially outwardly from the first annular passage; and further comprising a second annular passage formed between the first and second portions in communication with the transition passage and the at least one lubrication through passage in the first portion.

21. The apparatus of claim 1 further comprising an outer surface on the pilot tube; a check valve passage formed in the pilot tube adjacent the leading end thereof extending from the line of sight passage to the outer surface of the pilot tube; and a check valve within the check valve passage to allow water to be blown out of the line of sight passage.

22. The apparatus of claim 1 further comprising a motor which is disposed adjacent the trailing end of the pilot tube and is operatively connected to the pilot tube for driving rotation of the pilot tube; and a line of sight passage formed in the motor in communication with the line of sight passage in the pilot tube so that the line of sight passages provide a clear line of sight through the motor and the pilot tube from adjacent the motor to adjacent the leading end of the pilot tube during formation of the pilot hole.

23. The apparatus of claim 1 wherein the pilot tube comprises a plurality of pilot tube segments each having a seal and wherein the plurality of pilot tubes are removably connected to each other.

24. A method comprising the steps of:

driving a pilot tube having leading and trailing ends into the earth to form a pilot hole therein adapted for guiding an auger;

moving water from the trailing end toward the leading end through a lubricant through passage formed in the pilot tube during the step of driving; and during the step of moving, sensing a target from a position adjacent the trailing end through a central line of sight passage which is formed in the pilot tube from the trailing end to adjacent the leading end; wherein the target is disposed adjacent the leading end within the central line of sight passage.

25. The method of claim 24 wherein the step of sensing comprises the step of sensing the target with a camera disposed adjacent the trailing end of the pilot tube.

26. The method of claim 24 wherein the step of sensing comprises the step of sensing the target through a line of sight through passage which is formed in a first portion of a lubrication feed swivel and which is in communication with the line of sight passage in the pilot tube, the first portion of the swivel being secured to the trailing end of the pilot tube; further comprising the step of rotating the pilot tube together with a second portion of the swivel relative to the first portion of the swivel; and wherein the step of moving comprises the step of moving water into a lubricant passage formed in the second portion, and therefrom into a lubricant passage formed in the first portion, and therefrom into the lubricant through passage in the pilot tube.

27. The method of claim 24 further comprising the step of steering the pilot tube based on the step of sensing by controlling rotation of the pilot tube and a steering head secured to the leading end of the pilot tube.

28. The method of claim 24 further comprising the step of driving rotation of the pilot tube with a motor; and wherein the step of sensing comprises the step of sensing the target through a line of sight passage which is formed in the motor and which is in communication with the line of sight passage in the pilot tube.

* * * * *